US009954289B2

(12) United States Patent
Miyakawa et al.

(10) Patent No.: US 9,954,289 B2
(45) Date of Patent: Apr. 24, 2018

(54) TERMINAL WITH WIRE, MANUFACTURING METHOD OF TERMINAL WITH WIRE, AND WIRE HARNESS

(71) Applicant: Yazaki Corporation, Tokyo (JP)

(72) Inventors: Daisuke Miyakawa, Susono (JP); Tomonori Kawakami, Hamamatsu (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 15/157,729

(22) Filed: May 18, 2016

(65) Prior Publication Data

US 2016/0344115 A1 Nov. 24, 2016

(30) Foreign Application Priority Data

May 20, 2015 (JP) ..... 2015-102587
May 20, 2015 (JP) ..... 2015-102589

(51) Int. Cl.
*H01R 43/20* (2006.01)
*H01R 43/16* (2006.01)
(Continued)

(52) U.S. Cl.
CPC ..... *H01R 4/70* (2013.01); *H01R 13/113* (2013.01); *H01R 13/52* (2013.01); *H01R 43/20* (2013.01)

(58) Field of Classification Search
CPC ..... H01R 4/70; H01R 43/20; H01R 13/113; H01R 13/52
(Continued)

(56) References Cited

U.S. PATENT DOCUMENTS 4,225,398 A * 9/1980 Hasegawa ..... B05D 7/14 205/201
4,911,811 A 3/1990 Mullaney, Jr.
(Continued)

FOREIGN PATENT DOCUMENTS

CN 101080324 A 11/2007
DE 39 13 014 A1 1/1990
(Continued)

OTHER PUBLICATIONS

Office Action dated Aug. 1, 2017, issued for the Chinese patent application No. 201610342091.6 and English translation thereof.
(Continued)

*Primary Examiner* — Peter DungBa Vo
*Assistant Examiner* — Kaying Kue
(74) *Attorney, Agent, or Firm* — Locke Lord LLP

(57) ABSTRACT

A terminal with a wire having a high sealing property, a manufacturing method thereof, and a wire harness are provided. The terminal with the wire includes an aluminum wire and a crimp terminal. A resin covering member is removed from the aluminum wire to form a conductor exposed portion (a wire forming process). The crimp terminal is connected to the conductor exposed portion to form a wire-terminal connection portion (a wire-terminal connection process). Then, an anticorrosion portion is formed such that a voltage is applied between the crimp terminal and a metal nozzle and an electrified anticorrosion material is supplied from the metal nozzle to the wire-terminal connection portion in a state of being attracted (an anticorrosion material supply process). Further, the anticorrosion portion is formed by irradiating the anticorrosion material with an ultraviolet ray to be UV-cured (an anticorrosion material curing process).

5 Claims, 13 Drawing Sheets

(51) Int. Cl.

| | |
|---|---|
| ***H01R 43/18*** | (2006.01) |
| ***H01R 4/70*** | (2006.01) |
| ***H01R 13/11*** | (2006.01) |
| ***H01R 13/52*** | (2006.01) |

(58) Field of Classification Search
USPC ..... 29/883, 874, 885, 875–882, 828
See application file for complete search history.

(56) References Cited

U.S. PATENT DOCUMENTS

| | | | | |
|---|---|---|---|---|
| 5,832,595 | A | 11/1998 | Maruyama et al. | |
| 6,334,798 | B1 * | 1/2002 | Ushijima | H01R 4/187 439/203 |
| 7,422,307 | B2 * | 9/2008 | Yogi | B41J 2/211 347/21 |
| 7,607,753 | B2 * | 10/2009 | Yogi | B01L 3/0268 347/10 |
| 7,690,766 | B2 | 4/2010 | Ueno et al. | |
| 8,266,798 | B2 * | 9/2012 | Martauz | H01R 4/184 29/852 |
| 8,771,015 | B2 * | 7/2014 | Inoue | H01R 4/70 439/604 |
| 8,870,611 | B2 | 10/2014 | Sato et al. | |
| 9,293,838 | B2 * | 3/2016 | Sakaguchi | H01R 4/62 |
| 9,343,618 | B2 | 5/2016 | Nonogawa et al. | |
| 9,721,700 | B2 * | 8/2017 | Kuriyagawa | H02G 1/14 |
| 2002/0022409 | A1 | 2/2002 | Caridei | |
| 2004/0182948 | A1 * | 9/2004 | Yogi | B01F 5/0085 239/3 |
| 2006/0038860 | A1 * | 2/2006 | Yogi | B41J 2/06 347/82 |
| 2007/0273718 | A1 * | 11/2007 | Yogi | B01L 3/0268 347/10 |
| 2010/0077792 | A1 * | 4/2010 | Gurin | C10M 105/72 62/470 |
| 2013/0072074 | A1 * | 3/2013 | Inoue | H01R 4/70 439/886 |
| 2015/0140202 | A1 * | 5/2015 | Sato | H01R 4/185 427/58 |
| 2015/0140874 | A1 * | 5/2015 | Sakaguchi | H01R 4/62 439/879 |
| 2015/0287496 | A1 * | 10/2015 | Sato | H01R 4/62 174/74 R |

FOREIGN PATENT DOCUMENTS

| | | | |
|---|---|---|---|
| DE | 198 45 098 | A1 | 4/2000 |
| DE | 11 2011 101 154 | T5 | 1/2013 |
| JP | 2011-113708 | A | 6/2011 |
| JP | 2012-033378 | A | 2/2012 |
| JP | 2014-192502 | A | 10/2014 |
| JP | 2016219230 | A * | 12/2016 |

OTHER PUBLICATIONS

Office Action dated Oct. 12, 2017, issued for the corresponding German patent application No. 10 2016 208 723.1 and English translation thereof.

Office Action dated Feb. 27, 2018, issued for the Chinese patent application No. 201610342091.6 and English translation thereof.

* cited by examiner

TERMINAL WITH WIRE, MANUFACTURING METHOD OF TERMINAL WITH WIRE, AND WIRE HARNESS

BACKGROUND

Technical Field

The present invention relates to a terminal with a wire which includes an anticorrosion portion formed at a connection portion of heterogeneous metals in a wire and terminal metal fitting, a manufacturing method of the terminal with the wire, and a wire harness containing the terminal with the wire.

Related Art

For example, a wire harness is routed in a vehicle in order to electrically connect devices mounted in the vehicle. The wire harness is configured to include wire bundles and various types of connectors provided at the ends of the wire bundles. The connector of the wire harness is configured to include an insulative connector housing and a plurality of conductive terminal metal fittings contained in a terminal housing chamber of the connector housing. The terminal metal fitting is provided at the end of a wire of the wire bundle. As the wire, a copper wire (a conductor is made of copper or copper alloy in a twisted form) is generally used. Then, after the end of the copper wire is stripped, the copper wire is crimped by the terminal metal fitting and connected thereto. Further, the terminal metal fitting has a copper or copper alloy base material as the conductor of the copper wire, and may be plated.

In recent years, an aluminum wire ("aluminum wire" in this specification means an aluminum or aluminum alloy conductor) has been used in place of the copper wire in consideration of reduction in weight of a vehicle and ease of recycling materials in addition to shortage of copper resources. However, it is known that an oxide film formed in the aluminum wire is thick compared to a copper material of the copper wire. Further, it is known that the aluminum wire tends to have a relatively-high contact resistance between the conductor and the terminal metal fitting (a crimp terminal). Therefore, there is employed a method of increasing a compression ratio by strongly caulking the conductor using a pair of conductor caulking pieces formed in the crimp terminal in order to decrease the contact resistance between the conductor of the aluminum wire and the crimp terminal. According to the method, the oxide films of element wires of the conductor can be destructed by strongly caulking the conductor of the aluminum wire. In other words, the contact resistance between the conductor and the crimp terminal can be decreased.

However, it is known that, when moisture is present in the contact portion, both aluminum and copper are ionized and melt into the water so as to cause a potential difference therebetween. Therefore, electrolytic corrosion occurs in a contact portion between an aluminum material and a copper material (in other words, the contact portion of heterogeneous metals). Further, when the conductor of the aluminum wire and the copper or copper alloy crimp terminal are electrically and mechanically connected, a crimp portion of the conductor by the conductor caulking piece of the crimp terminal is crimped at a high compression. Therefore, the moisture is prevented from entering and, as a result, the occurrence of the electrolytic corrosion is avoided. However, since the conductor is partially exposed at a position in an axial direction (an extension direction of the wire) of the terminal with respect to the crimp portion of the conductor by the conductor caulking piece (an extension direction of the wire), the moisture is attached thereto and reaches up to the crimp portion. Then, the crimp portion comes into a state like dipping in an electrolytic solution, thereby dissolving the aluminum of a highly ionizing tendency and progressing the electrolytic corrosion. Therefore, in order to prevent the moisture from being attached to the exposed portion of the conductor and from entering the crimp portion, an anticorrosion portion 115 (sealing portion) illustrated in FIGS. 13A and 13B is formed in the related art (for example, see Patent Literature 1).

In FIGS. 13A and 13B, the reference numeral 101 indicates an aluminum wire, and the reference numeral 102 indicates a crimp terminal. The aluminum wire 101 is configured to include an aluminum or aluminum alloy conductor 103 and an insulative resin covering member 104 covering the conductor 103. The end of the resin covering member 104 of the aluminum wire 101 is removed to form a conductor exposed portion 105. On the other hand, the crimp terminal 102 is a male terminal metal fitting, and is formed in a shape as illustrated in the drawing by pressing a copper or copper-alloy metal plate. The crimp terminal 102 includes an electrical contact portion 106 of a rectangular tube shape, a caulking portion 107, and a connection portion 108 which connects the electrical contact portion 106 and the caulking portion 107. In the caulking portion 107, there are formed a mounting portion 109 which is used to mount the conductor exposed portion 105, a conductor caulking piece 110 which is used to caulk the conductor exposed portion 105 mounted in the mounting portion 109, and a covering-member caulking piece 111 which is used to caulk the resin covering member 104 near the conductor exposed portion 105.

In the configuration and the structure described above, a wire-terminal connection portion 118 is formed including a conductor caulking portion 112 which is formed by caulking the conductor exposed portion 105 using the conductor caulking piece 110 and a covering-member caulking portion 113 which is formed by caulking the resin covering member 104 near the conductor exposed portion 105 using the covering-member caulking piece 111. Further, in the conductor caulking portion 112, a non-caulking portion 114 is generated from a relation between a length of the conductor exposed portion 105 and a width of the conductor caulking piece 110. Therefore, the anticorrosion portion 115 (sealing portion) is formed in the wire-terminal connection portion 118 to cover the non-caulking portion 114. The anticorrosion material 117 (sealing material) is dropped from the respective nozzles 116 of two dispensers. Then, the anticorrosion material 117 coated with the dropped anticorrosion material is cured to form the anticorrosion portion 115. Further, silicon rubber is employed as the anticorrosion material 117.

Patent Literature 1: JP 2011-113708 A

SUMMARY

In the related art described above, since the anticorrosion material 117 is dropped from the respective nozzles 116 of the two dispensers, and a surface tension occurs in the anticorrosion material 117 thus dropped and coated, the anticorrosion material does not become attached to the non-caulking portion 114 in the wire-terminal connection portion 118. Therefore, when liquid dropping occurs, the anticorrosion portion 115 is not formed in a sufficient state.

In addition, in the related art described above, since the anticorrosion portion 115 is formed to cover the non-caulking portion 114 (in other words, the anticorrosion portion 115 is formed only in a portion of the wire-terminal connection portion 118), the anticorrosion portion 115 is not formed in a sufficient state.

The invention has been made in view of the problems, and an object thereof is to provide a terminal with a wire having a high sealing property (high anticorrosion property and high waterproofing property), a manufacturing method of the terminal with the wire, and a wire harness.

According to a first aspect of the invention made to solve the above problem, a terminal with a wire includes a wire-terminal connection portion and a sealing portion. To form the wire-terminal connection portion, a terminal metal fitting is connected at a position of a conductor exposed portion formed by removing a resin covering member of a wire. The sealing portion is formed to cover the wire-terminal connection portion. A voltage is applied between the terminal metal fitting and a metal nozzle, and an electrified sealing material is supplied from the metal nozzle to the wire-terminal connection portion in a state of being attracted to form the sealing portion.

According to the invention having such a feature, the sealing material is attracted to the wire-terminal connection portion by an electrostatic force. In addition, since an attracting force caused by the electrostatic force is operated on the sealing material supplied to the wire-terminal connection portion, the sealing material remains in the wire-terminal connection portion.

The invention according to a second aspect is the terminal with the wire according to the first aspect, wherein the sealing portion is formed over the entire peripheral surface surround an axis of the terminal metal fitting in the wire-terminal connection portion.

According to the invention having such a feature, the electrified sealing material is attracted by the electrostatic force to go around to the opposite side of a supply position. In other words, the sealing material is supplied over the entire peripheral surface of the wire-terminal connection portion. The sealing material supplied over the entire peripheral surface remains at that place by the attracting force cause by the electrostatic force.

The invention according to a third aspect is the terminal with the wire according to the first or second aspect, wherein the electrified sealing material is supplied to the wire-terminal connection portion to be UV-cured so as to form the sealing portion.

According to the invention having such a feature, it is effectively employed a sealing material made of an ultraviolet curable resin. The sealing material remains in the wire-terminal connection portion by the attracting force caused by the electrostatic force. Then, when being irradiated with an ultraviolet ray in the remaining state using a UV lamp for example, the sealing material receives energy caused by the ultraviolet ray and is cured while keeping the remaining state.

The invention according to a fourth aspect is the terminal with the wire according to the first, second or third aspect, wherein the wire-terminal connection portion is formed including a conductor caulking portion which caulks the conductor exposed portion using a conductor caulking piece of the terminal metal fitting, a non-caulking portion near the conductor caulking portion, and a covering-member caulking portion which caulks the resin covering member near the conductor exposed portion using a covering-member caulking piece of the terminal metal fitting.

According to the invention having such a feature, the wire-terminal connection portion is formed including the conductor caulking portion, the non-caulking portion near the conductor caulking portion, and the covering-member caulking portion. The sealing portion is formed in a relatively wide range.

Further, a manufacturing method of a terminal with a wire according to a fifth aspect of the invention made to solve the above problem is a manufacturing method of a terminal with a wire including: a wire forming process in which a resin covering member is removed from a wire to form a conductor exposed portion; a wire-terminal connection process in which a terminal metal fitting is connected at a position of the conductor exposed portion to form a wire-terminal connection portion; and a sealing material supply process in which a voltage is applied between the terminal metal fitting and a metal nozzle, and an electrified sealing material is supplied from the metal nozzle to the wire-terminal connection portion in a state of being attracted to form a sealing portion to cover the wire-terminal connection portion.

According to the invention having such a feature, in the sealing material supply process, the sealing material is attracted to the wire-terminal connection portion by the electrostatic force. In addition, the sealing material supplied to the wire-terminal connection portion remains in the wire-terminal connection portion by the attracting force caused by the electrostatic force.

The invention according to a sixth aspect is the manufacturing method of the terminal with the wire according to the fifth aspect, wherein, in the sealing material supply process, the electrified sealing material is supplied to the wire-terminal connection portion in a predetermined direction, and the electrified sealing material is spread over the entire peripheral surface surround an axis of the terminal metal fitting in the wire-terminal connection portion by an electrostatic force.

According to the invention having such a feature, in the sealing material supply process, the electrified sealing material is attracted by the electrostatic force to go around to the opposite side of the supply position. In other words, even when being supplied in a predetermined direction, the sealing material is supplied over the entire peripheral surface of the wire-terminal connection portion. The sealing material supplied over the entire peripheral surface remains at that place by the attracting force cause by the electrostatic force.

The invention according to a seventh aspect is the manufacturing method of the terminal with the wire according to the fifth or sixth aspect, wherein the electrified sealing material is supplied in a substantial stringiness state from the metal nozzle to the wire-terminal connection portion.

According to the invention having such a feature, in the sealing material supply process, when the electrified sealing material is attracted by the electrostatic force so as to be in a substantial stringiness state, the electrified sealing material is supplied in this stringiness state. In other words, the sealing material is supplied from the metal nozzle to the wire-terminal connection portion in a continuously narrow state.

The invention according to an eighth aspect is the manufacturing method of the terminal with the wire according to the fifth, sixth, or seventh aspect, wherein, as a process after the sealing material supply process of forming the sealing portion, a sealing material curing process is further included to UV-cure the electrified sealing material.

According to the invention having such a feature, the sealing material made of an ultraviolet curable resin is employed. Such a sealing material is operated by the attracting force caused by the electrostatic force in the sealing material curing process, and remains in the wire-terminal connection portion. Then, when being irradiated with the ultraviolet ray in the remaining state using the UV lamp for example, the sealing material receives energy caused by the ultraviolet ray and is cured while keeping the remaining state.

The invention according to a ninth aspect is the manufacturing method of the terminal with the wire according to the fifth, sixth, seventh, or eighth aspect, wherein, as the wire-terminal connection process, the wire-terminal connection portion is formed in a range containing a conductor caulking portion which caulks the conductor exposed portion using a conductor caulking piece of the terminal metal fitting, a non-caulking portion near the conductor caulking portion, and a covering-member caulking portion which caulks the resin covering member near the conductor exposed portion using a covering-member caulking piece of the terminal metal fitting.

According to the invention having such a feature, in the wire-terminal connection process, the wire-terminal connection portion is formed including the conductor caulking portion, the non-caulking portion near the conductor caulking portion, and the covering-member caulking portion. Then, in the subsequent process, the sealing portion is formed in a relatively wide range.

Further, a wire harness according to a tenth aspect of the invention made to solve the above problem is a wire harness in which a connector is configured by including the terminal with the wire according to the first, second, third, or fourth aspect and a connector housing which contains the terminal with the wire, and the connector is disposed at an end.

According to the invention having such a feature, the wire harness including the terminal with the wire is formed.

Further, according to the first aspect of the invention, the following feature is achieved when the wire is limited to an aluminum wire, the terminal metal fitting to a heterogeneous metal with respect to the aluminum wire, the sealing material to an anticorrosion material, and the sealing portion to an anticorrosion portion. In other words, "A terminal with a wire in which a terminal metal fitting having a copper or copper alloy base material is connected at a position of a conductor exposed portion formed by removing a resin covering member of a wire, which includes an aluminum or aluminum alloy conductor and the insulative resin cover member covering the conductor, to form a wire-terminal connection portion, and an anticorrosion portion is formed to cover the wire-terminal connection portion, wherein a voltage is applied between the terminal metal fitting and the metal nozzle, and the electrified anticorrosion material is supplied from the metal nozzle to the wire-terminal connection portion in a state of being attracted to form the anticorrosion portion".

In addition, according to the first aspect of the invention, the following feature is achieved when the sealing material is limited to a waterproofing material, and the sealing portion to a waterproofing portion. In other words, "A terminal with a wire in which a terminal metal fitting is connected at a position of a conductor exposed portion formed by removing a resin covering member of a wire to form a wire-terminal connection portion, and a waterproofing portion is formed to cover the wire-terminal connection portion, wherein a voltage is applied between the terminal metal fitting and a metal nozzle, and an electrified waterproofing material is supplied from the metal nozzle to the wire-terminal connection portion in a state of being attracted".

In addition, according to the fifth aspect of the invention, the following feature is achieved when the wire is limited to the aluminum wire, the terminal metal fitting to a heterogeneous metal with respect to the aluminum wire, the sealing material to an anticorrosion material, and the sealing portion to the anticorrosion portion. In other words, "a manufacturing method of a terminal with a wire, including: a wire forming process in which a resin covering member is removed from a wire, which includes an aluminum or aluminum alloy conductor and the insulative resin cover member covering the conductor, to form a conductor exposed portion; a wire-terminal connection process in which a terminal metal fitting having a copper or copper alloy base material is connected at a position of the conductor exposed portion to form a wire-terminal connection portion; and an anticorrosion material supply process in which a voltage is applied between the terminal metal fitting and a metal nozzle in order to form an anticorrosion portion covering the wire-terminal connection portion, and an electrified anticorrosion material is supplied from the metal nozzle to the wire-terminal connection portion in a state of being attracted.

In addition, according to the fifth aspect of the invention, the following feature is achieved when the sealing material is limited to a waterproofing material and the sealing portion to the waterproofing portion. In other words, "a manufacturing method of a terminal with a wire, including: a wire forming process in which a resin covering member is removed from a wire to form a conductor exposed portion; a wire-terminal connection process in which a terminal metal fitting is connected at a position of the conductor exposed portion to form a wire-terminal connection portion; and a sealing material supply process in which a voltage is applied between the terminal metal fitting and a metal nozzle, and an electrified sealing material is supplied from the metal nozzle to the wire-terminal connection portion in a state of being attracted to forma sealing portion to cover the wire-terminal connection portion".

Further, a terminal with a wire according to an eleventh aspect of the invention made to solve the above problem is a terminal with a wire in which a terminal metal fitting is connected at a position of a conductor exposed portion formed by removing a resin covering member of a wire to form a wire-terminal connection portion, and a sealing portion is formed to cover the wire-terminal connection portion, wherein the sealing portion is formed such that a sealing material, which is made of an ultraviolet curable resin and emits the light when receiving energy of an ultraviolet ray, is supplied to the wire-terminal connection portion, and the sealing material is irradiated with the ultraviolet ray so as to be UV-cured.

According to the invention having such a feature, there is provided a terminal with a wire corresponding to a manufacturing method of a thirteenth or fourteenth aspect described below.

The invention according to a twelfth aspect is the terminal with the wire according to the eleventh aspect, wherein the wire-terminal connection portion is formed including a conductor caulking portion which caulks the conductor exposed portion using a conductor caulking piece of the terminal metal fitting, a non-caulking portion near the conductor caulking portion, and a covering-member caulking portion which caulks the resin covering member near the conductor exposed portion using a covering-member caulking piece of the terminal metal fitting, and wherein the sealing portion is formed in a range covering the wire-terminal connection portion.

According to the invention having such a feature, there is provided a terminal with a wire corresponding to a manufacturing method of a fifteenth aspect described below.

Further, a manufacturing method of a terminal with a wire according to a thirteenth aspect of the invention made to solve the above problem is a manufacturing method of a terminal with a wire including: a wire forming process in which a resin covering member is removed from a wire to form a conductor exposed portion; a wire-terminal connection process in which a terminal metal fitting is connected at a position of the conductor exposed portion to form a wire-terminal connection portion; a sealing material supply process in which a sealing material, which is made of an ultraviolet curable resin and emits the light when receiving energy of an ultraviolet ray, is supplied to the wire-terminal connection portion in order to form a sealing portion covering the wire-terminal connection portion; and a sealing material curing process in which the sealing material is irradiated with the ultraviolet ray to be UV-cured, wherein, in the sealing material curing process, the sealing material in an emission state by the irradiation with the ultraviolet ray is captured by a camera while eliminating a disturbance light using an optical filter, and a quality of a supply area of the sealing material is determined based on an image captured by the camera.

According to the invention having such a feature, when the sealing material supplied to the wire-terminal connection portion is irradiated with the ultraviolet ray, the sealing material irradiated with the ultraviolet ray is cured in a short time. In addition, the sealing material irradiated with the ultraviolet ray emits the light. In a case where a quality determination on a supply area of the sealing material is performed, it is a matter of course that the sealing material can be easily identified when the sealing material emits the light compared to the other case. In the invention, since the sealing material emits the light, the quality determination on the supply area of the sealing material is easily and reliably performed. In addition, in the invention, since a disturbance light is eliminated by an optical filter, the quality determination on the supply area of the sealing material is more easily and reliably performed.

The invention according to a fourteenth aspect is the manufacturing method of the terminal with the wire according to the thirteenth aspect, wherein, in the sealing material curing process, it is determined whether there is a bubble in the sealing material based on the image captured by the camera.

According to the invention having such a feature, since the sealing material emits the light when being irradiated with the ultraviolet ray, it is possible to determine whether there is a bubble in the anticorrosion material from the image of the emitted sealing material.

The invention according to a fifteenth aspect of the invention is the manufacturing method of the terminal with the wire according to the thirteenth or fourteenth aspect, wherein, as the wire-terminal connection process, the wire-terminal connection portion is formed in a range containing a conductor caulking portion which caulks the conductor exposed portion using a conductor caulking piece of the terminal metal fitting, a non-caulking portion near the conductor caulking portion, and a covering-member caulking portion which caulks the resin covering member near the conductor exposed portion using a covering-member caulking piece of the terminal metal fitting, and wherein the sealing portion is formed to cover the wire-terminal connection portion.

According to the invention having such a feature, the wire-terminal connection portion is formed including the conductor caulking portion, the non-caulking portion near the conductor caulking portion, and the covering-member caulking portion. Then, in the subsequent process, the sealing portion is formed in a relatively wide range.

Further, a wire harness according to a sixteenth aspect of the invention made to solve the above problem is a wire harness in which a connector is configured by including the terminal with the wire according to the eleventh or twelfth aspect and a connector housing which contains the terminal metal fitting of the terminal with the wire, and the connector is disposed at an end.

According to the invention having such a feature, the wire harness including the terminal with the wire is formed.

Further, according to the eleventh aspect of the invention, the following feature is achieved when the wire is limited to the aluminum wire, the terminal metal fitting to a heterogeneous metal with respect to the aluminum wire, the sealing material to the anticorrosion material, and the sealing portion to the anticorrosion portion. In other words, "a terminal with a wire in which a terminal metal fitting having a copper or copper alloy base material is connected at a position of a conductor exposed portion formed by removing a resin covering member of a wire, which includes an aluminum or aluminum alloy conductor and the insulative resin cover member covering the conductor, to form a wire-terminal connection portion, and an anticorrosion portion is formed to cover the wire-terminal connection portion, wherein the anticorrosion portion is formed such that an anticorrosion material which is made of an ultraviolet curable resin and emits the light when receiving energy of an ultraviolet ray is supplied to the wire-terminal connection portion, and the anticorrosion material is irradiated with the ultraviolet ray so as to be UV-cured".

In addition, according to the eleventh aspect of the invention, the following feature is achieved when the sealing material is limited to a waterproofing material and the sealing portion to the waterproofing portion. In other words, "A terminal with a wire in which a terminal metal fitting is connected at a position of a conductor exposed portion formed by removing a resin covering member of a wire to form a wire-terminal connection portion, and a waterproofing portion is formed to cover the wire-terminal connection portion, wherein the waterproofing portion is formed such that a waterproofing material which is made of an ultraviolet curable resin and emits the light when receiving energy of an ultraviolet ray is supplied to the wire-terminal connection portion, and the waterproofing material is irradiated with the ultraviolet ray so as to be UV-cured".

In addition, according to the thirteenth or fourteenth aspect of the invention, the following feature is achieved when the wire is limited to the aluminum wire, the terminal metal fitting to a heterogeneous metal with respect to the aluminum wire, the sealing material to an anticorrosion material, and the sealing portion to the anticorrosion portion. In other words, "a manufacturing method of A terminal with a wire, including: a wire forming process in which a resin covering member is removed from a wire, which includes an aluminum or aluminum alloy conductor and the insulative resin cover member covering the conductor, to form a conductor exposed portion; a wire-terminal connection process in which a terminal metal fitting having a copper or copper alloy base material is connected at a position of the conductor exposed portion to form a wire-terminal connection portion; an anticorrosion material supply process in which an anticorrosion material which is made of an ultraviolet curable resin and emits the light when receiving energy of an ultraviolet ray is supplied to the wire-terminal connection portion in order to form an anticorrosion portion covering the wire-terminal connection portion; and an anticorrosion material curing process in which the anticorrosion material is irradiated with the ultraviolet ray to be UV-cured, wherein, in the anticorrosion material curing process, the anticorrosion material in an emission state by the irradiation with the ultraviolet ray is captured by a camera while eliminating a disturbance light using an optical filter, and a quality of a supply area of the anticorrosion material is determined based on an image captured by the camera", and "the manufacturing method of the terminal with the wire, wherein in the sealing material curing process, it is determined whether there is a bubble in the sealing material based on the image captured by the camera".

In addition, according to the thirteenth or fourteenth aspect of the invention, the following feature is achieved when the sealing material is limited to a waterproofing material, and the sealing portion to the waterproofing portion. In other words, "a manufacturing method of A terminal with a wire, including: a wire forming process in which a resin covering member is removed from a wire to form a conductor exposed portion; a wire-terminal connection process in which a terminal metal fitting is connected at a position of the conductor exposed portion to form a wire-terminal connection portion; a waterproofing material supply process in which a waterproofing material which is made of an ultraviolet curable resin and emits the light when receiving energy of an ultraviolet ray is supplied to the wire-terminal connection portion in order to form a waterproofing portion covering the wire-terminal connection portion; and a waterproofing material curing process in which the waterproofing material is irradiated with the ultraviolet ray to be UV-cured, wherein, in the waterproofing material curing process, the waterproofing material in an emission state by the irradiation with the ultraviolet ray is captured by a camera while eliminating a disturbance light using an optical filter, and a quality of a supply area of the waterproofing material is determined based on an image captured by the camera", and "the manufacturing method of the terminal with the wire, wherein, in the waterproofing material curing process, a bubble in the waterproofing material is determined based on the image captured by the camera".

According to the first aspect of the invention, it is possible to effectively make the sealing material remain in the wire-terminal connection portion by using the electrostatic force. Therefore, the liquid dropping of the sealing material is prevented. As a result, it is possible to effectively form the sealing portion in a sufficient state. Therefore, according to the invention, it is possible to effectively provide the terminal with the wire having a high sealing property.

According to the second aspect of the invention, it is possible to effectively spread the sealing material over the entire peripheral surface of the wire-terminal connection portion by using the electrostatic force. Therefore, it is possible to effectively form the sealing portion over the entire peripheral surface of the wire-terminal connection portion. In other words, it is possible to effectively form the sealing portion in a sufficient state. Therefore, according to the invention, it is possible to effectively provide the terminal with the wire having a high sealing property.

According to the third aspect of the invention, it is effectively employed the sealing material made of the ultraviolet curable resin. It is possible to effectively cure the sealing material in a state of remaining in the wire-terminal connection portion with ease and reliability. Therefore, according to the invention, it is possible to effectively provide the terminal with the wire having a high sealing property.

According to the fourth aspect of the invention, it is possible to effectively form the sealing portion in a wide range compared to the conventional example. Therefore, according to the invention, it is possible to effectively provide the terminal with the wire having a high sealing property.

According to the fifth aspect of the invention, it is possible to effectively provide the manufacturing method corresponding to the terminal with the wire of the first aspect.

According to the sixth aspect of the invention, it is possible to effectively provide the manufacturing method corresponding to the terminal with the wire of the second aspect.

According to the seventh aspect of the invention, it is possible to effectively provide the manufacturing method corresponding to the terminal with the wire of the first or second aspect.

According to the eighth aspect of the invention, it is possible to effectively provide the manufacturing method corresponding to the terminal with the wire of the third aspect.

According to the ninth aspect of the invention, it is possible to effectively provide the manufacturing method corresponding to the terminal with the wire of the fourth aspect.

According to the tenth aspect of the invention, it is possible to effectively provide the wire harness which includes the terminal with the wire of the first, second, third, or fourth aspect.

According to the eleventh aspect of the invention, the sealing portion is formed such that a sealing material which is made of an ultraviolet curable resin and emits the light when receiving energy of an ultraviolet ray is supplied to the wire-terminal connection portion, and the sealing material is irradiated with the ultraviolet ray so as to be UV-cured. Therefore, it is possible to effectively provide the terminal with the wire which is excellent in manufacturability and has a high anticorrosion property.

According to the twelfth aspect of the invention, the sealing portion is formed to cover the wire-terminal connection portion in a wide range compared to the conventional example. Therefore, it is possible to effectively provide the terminal with the wire which is enhanced still more in an anticorrosion property.

According to the thirteenth aspect of the invention, the sealing material made of the ultraviolet curable resin is employed. Therefore, it is possible to effectively cure the sealing material in a short time by irradiating the sealing material with the ultraviolet ray. In other words, it is possible to effectively form the sealing portion in a short time. Then, when the sealing portion can be formed in a short time, it is possible to effectively form the sealing portion without causing the liquid dropping and the sink mark. In addition, according to the invention, there is employed the sealing material which emits the light when receiving the energy of the ultraviolet ray. Therefore, it is possible to effectively determine a quality of the supply area of the sealing material with ease. In addition, according to the invention, the emission state of the sealing material is captured as an image. Therefore, it is possible to effectively perform the quality determination on the supply area of the sealing material with reliability. In addition, according to the invention, the optical filter is disposed to be disposed between the sealing material and the camera. The emission state of the sealing material can be captured as an image while eliminating the disturbance light. As a result, it is possible to effectively perform the quality determination on the supply area of the sealing material using such an image with reliability. When the sealing material is reliably supplied, it is possible to effectively form the sealing portion in a sufficient state. Therefore, according to the invention described above, it is possible to effectively provide the manufacturing method of the terminal with the wire which is excellent in manufacturability and has a high sealing property.

According to the fourteenth aspect of the invention, it is possible to effectively determine whether there is a bubble in the sealing material by irradiating the sealing material with the ultraviolet ray and by capturing an image of the emission state. Then, when it is determined that there is no bubble in the sealing material, it can be considered that the sealing portion is formed in a sufficient state. Further, it is possible to effectively manufacture the terminal with the wire having a high reliability. Therefore, according to the invention, it is possible to effectively provide the manufacturing method with more reliability.

According to the fifteenth aspect of the invention, the wire-terminal connection portion is formed including a conductor caulking portion, a non-caulking portion near the conductor caulking portion, and a covering-member caulking portion to cover the sealing portion. Therefore, it is possible to effectively form the sealing portion to cover a wide range compared to the conventional example. Therefore, according to the invention, it is possible to effectively provide the manufacturing method with more reliability.

According to the sixteenth aspect of the invention, it is possible to effectively provide the wire harness containing the terminal with the wire of the eleventh or twelfth aspect.

BRIEF DESCRIPTION OF DRAWINGS

FIGS. 9A and 9B are diagrams of a connector housing of FIG. 8, in which FIG. 9A is a perspective view and FIG. 9B is a cross-sectional view taken along a line C-C;

FIGS. 13A and 13B are diagrams of a conventional wire fitted terminal, in which FIG. 13A is a perspective view and FIG. 13B is a cross-sectional view taken along a line D-D.

DETAILED DESCRIPTION

<First Embodiment>

A terminal with a wire is configured to include an aluminum wire and a crimp terminal. The aluminum wire is configured to include an aluminum or aluminum alloy conductor and an insulative resin covering member which covers the conductor. The resin covering member is removed from the aluminum wire to form a conductor exposed portion. The crimp terminal includes a caulking portion as a crimp portion. In the caulking portion, a conductor caulking piece and a covering-member caulking piece are formed. The terminal with the wire crimps the caulking portion to the conductor exposed portion to form a wire-terminal connection portion. Then, an anticorrosion portion is formed to cover the wire-terminal connection portion. The anticorrosion portion is formed such that a voltage is applied between the crimp terminal and a metal nozzle and an electrified anticorrosion material is supplied from the metal nozzle to the wire-terminal connection portion in a state of being attracted. In addition, the anticorrosion portion is formed by irradiating the anticorrosion material supplied to the wire-terminal connection portion with an ultraviolet ray so as to be UV-cured.

[Examples]

Figure 1:
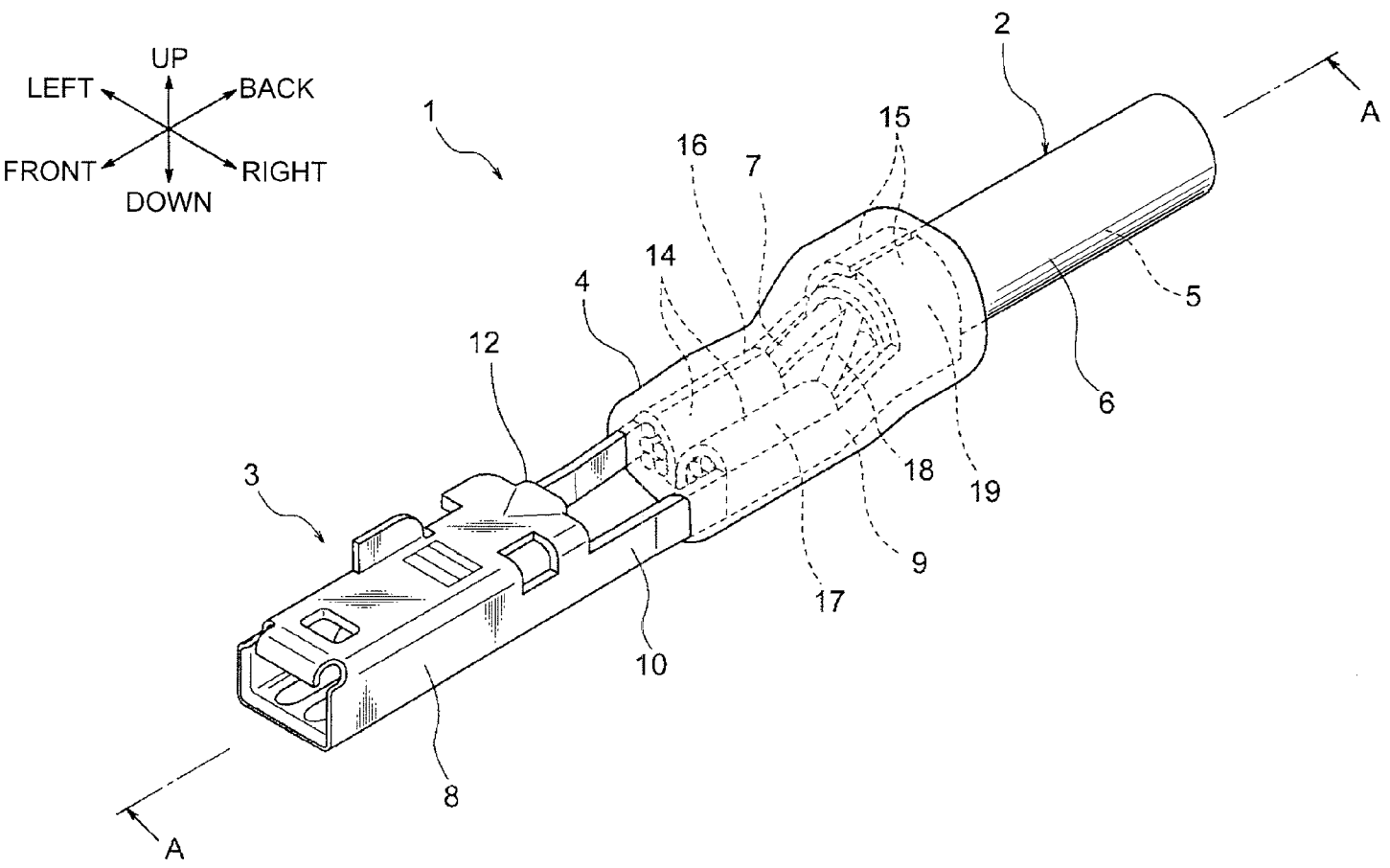
FIG. 1 is a perspective view illustrating a terminal with a wire in a first embodiment of the invention.
Figure 2:
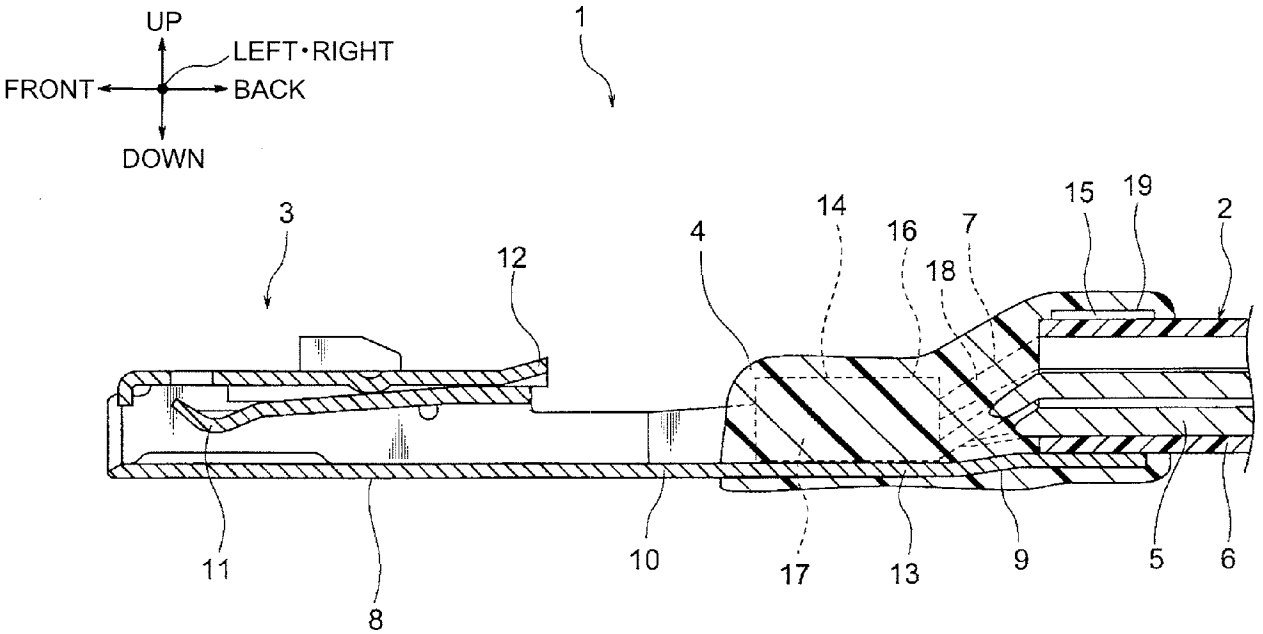
FIG. 2 is a cross-sectional view taken along a line A-A of FIG. 1.
Figure 3:
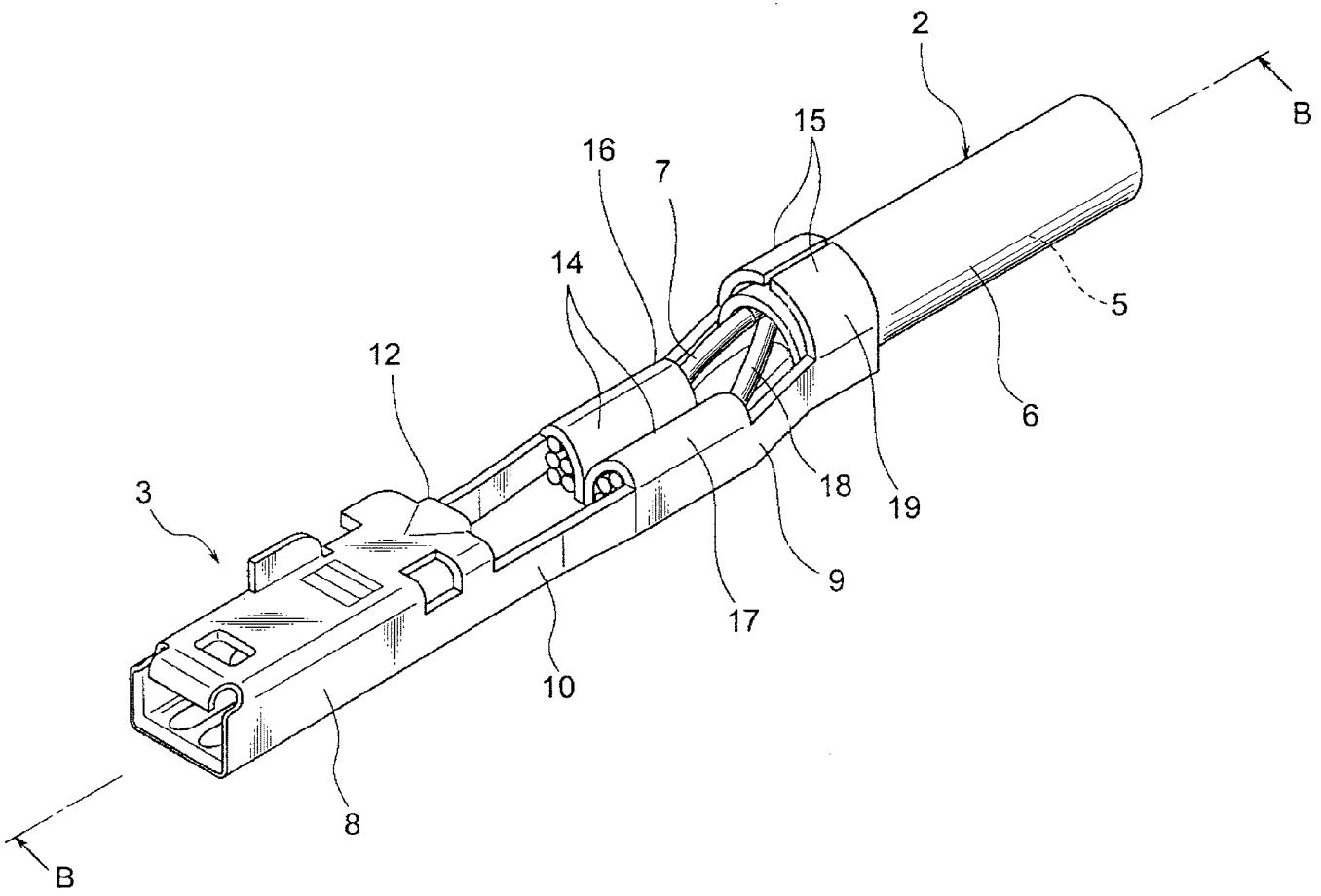
FIG. 3 is a perspective view of the terminal with the wire before an anticorrosion portion is formed.
Figure 4:
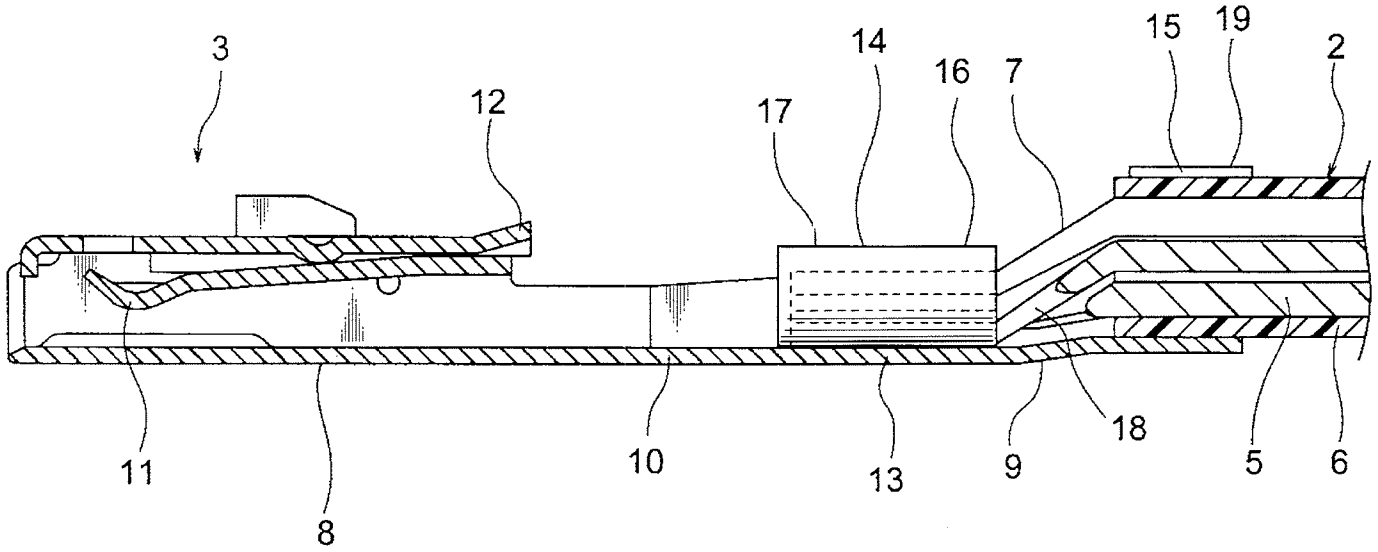
FIG. 4 is a cross-sectional view taken along a line B-B of FIG. 3.
Figure 5:
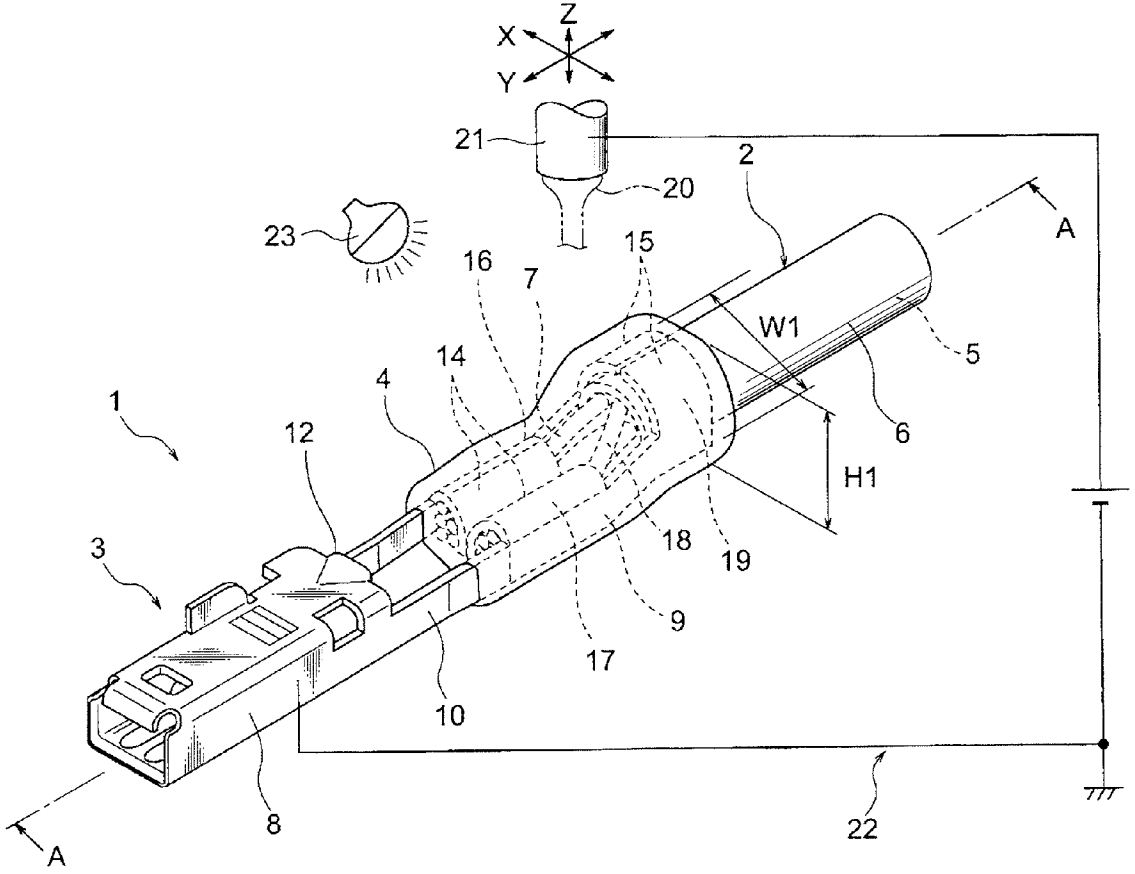
FIG. 5 is a perspective view of the terminal with the wire for describing a manufacturing method in the first embodiment of the invention.
Figure 6:
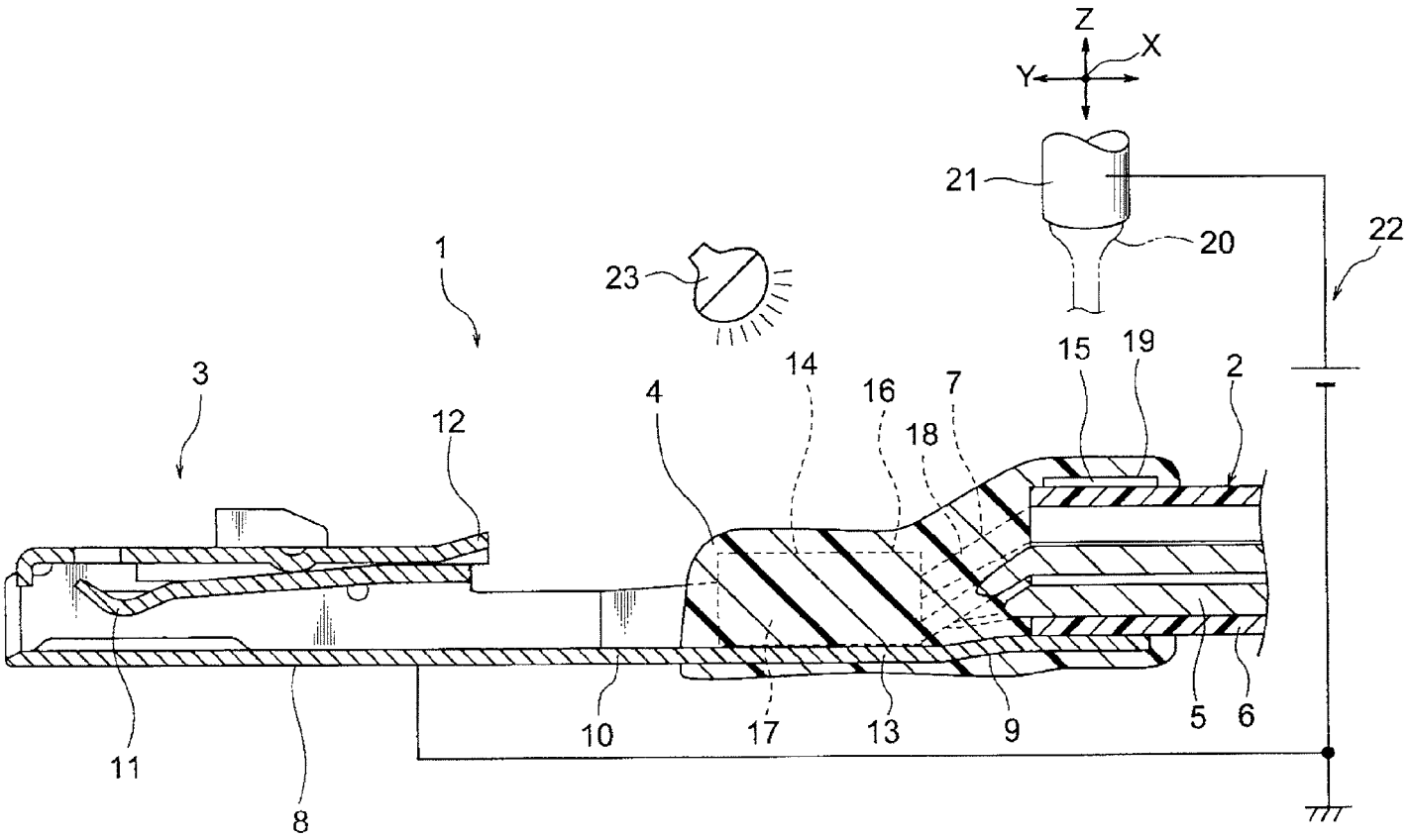
FIG. 6 is a cross-sectional view taken along a line A-A of FIG. 5.
Figure 7:
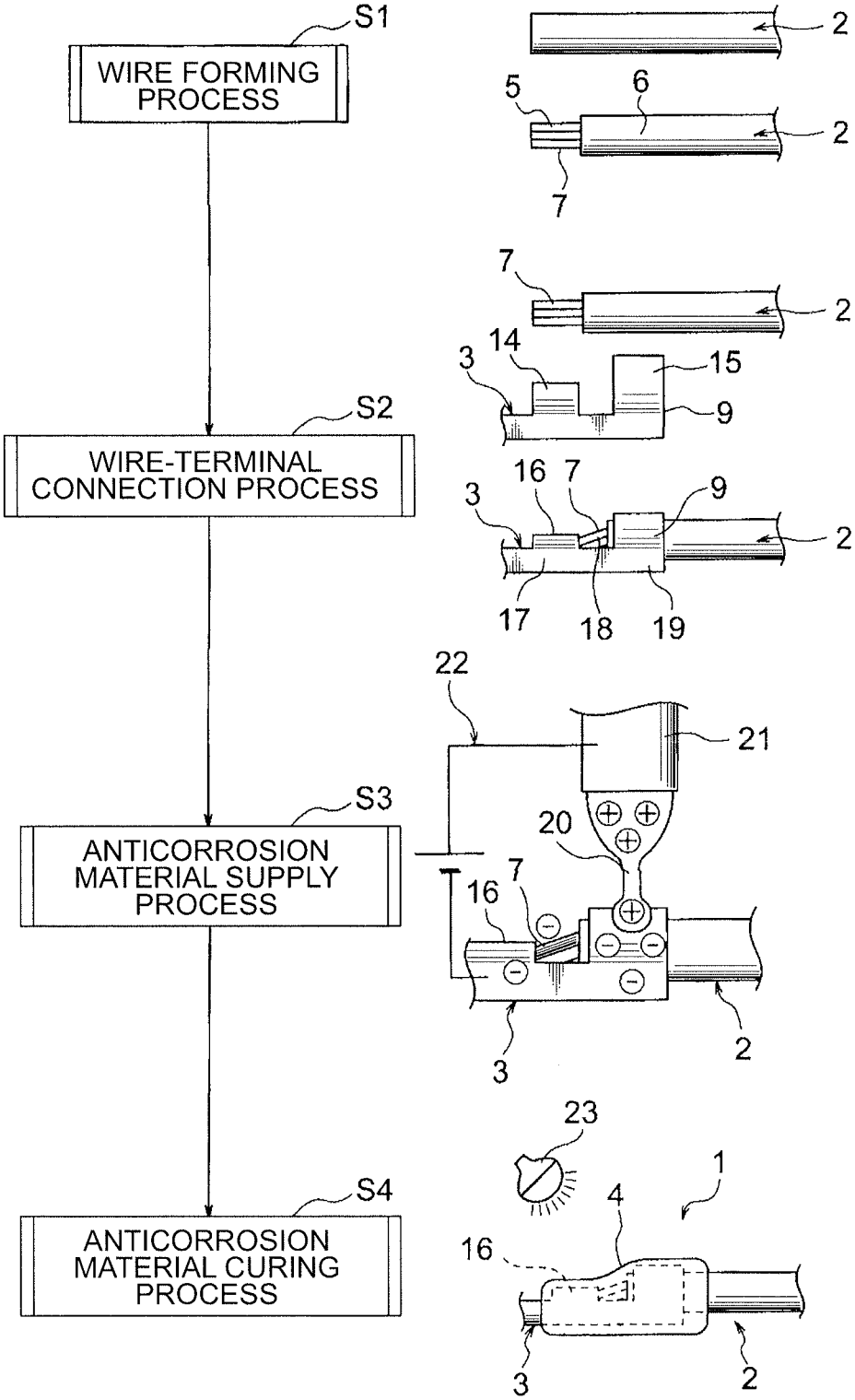
FIG. 7 is a diagram for describing a process of the manufacturing method in the first embodiment of the invention.
Figure 8:
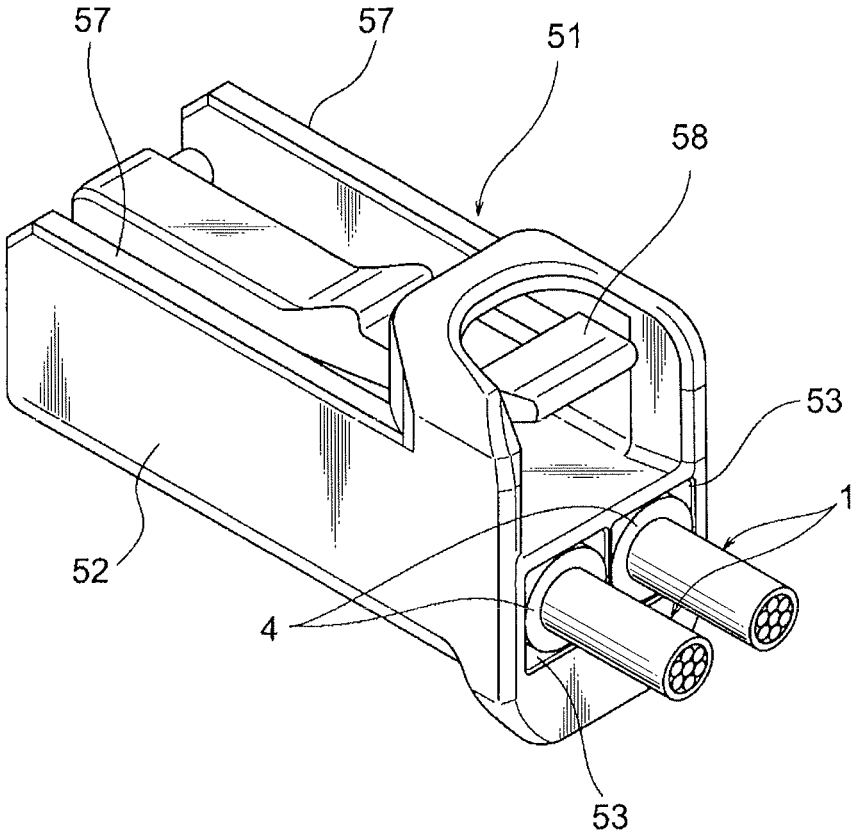
FIG. 8 is a perspective view of a connector of a wire harness in the first embodiment of the invention.
Figure 9A:
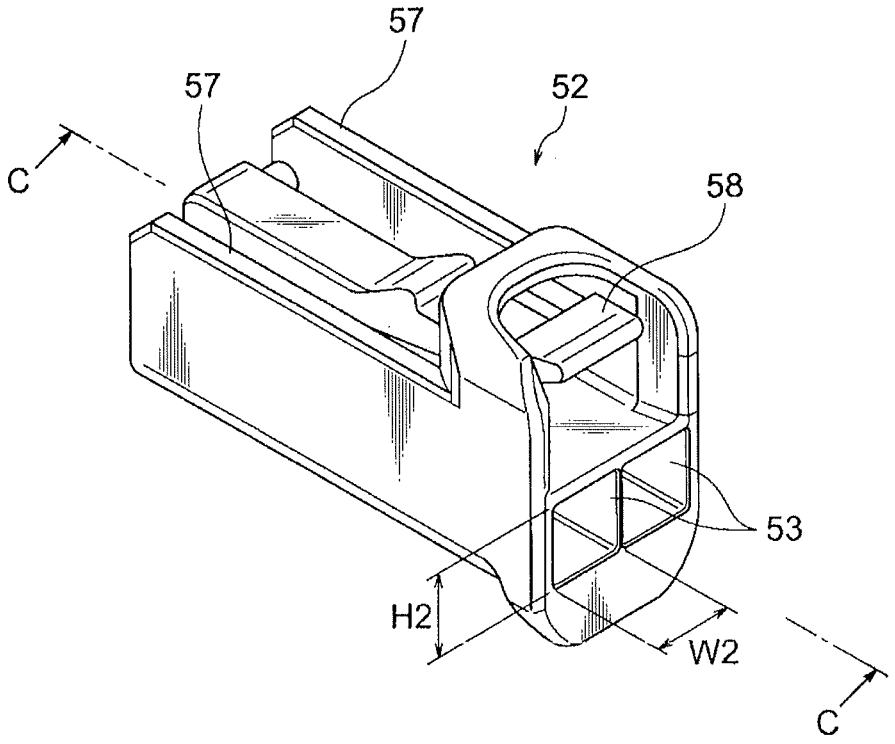
Figure 9B:
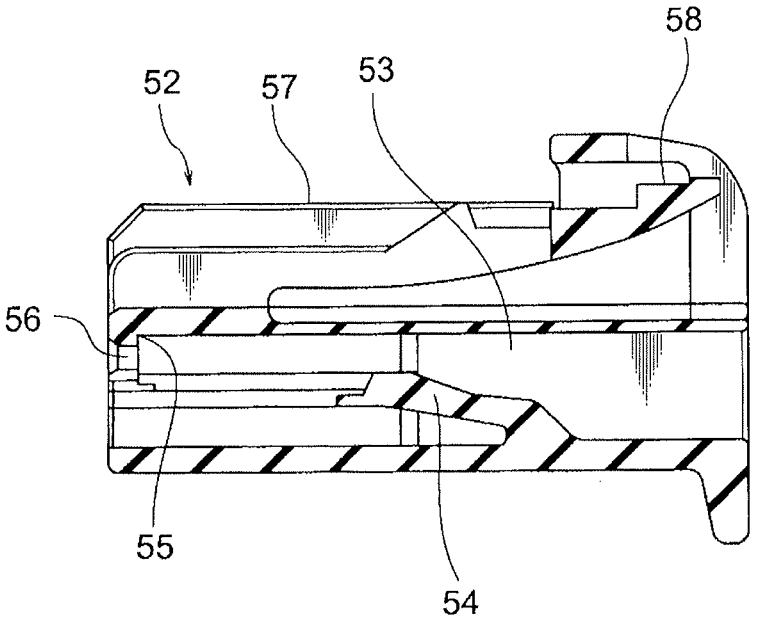

Hereinafter, examples of a first embodiment will be described with reference to the drawings. FIG. 1 is a perspective view illustrating the terminal with the wire in the first embodiment of the invention. In addition, FIG. 2 is a cross-sectional view taken along a line A-A of FIG. 1, FIG. 3 is a perspective view of the terminal with the wire before the anticorrosion portion is formed, and FIG. 4 is a cross-sectional view taken along a line B-B of FIG. 3. Further, FIG. 5 is a perspective view of the terminal with the wire for describing a manufacturing method in the first embodiment of the invention, FIG. 6 is a cross-sectional view taken along a line A-A of FIG. 5, and FIG. 7 is a diagram for describing a process of the manufacturing method in the first embodiment of the invention. Furthermore, FIG. 8 is a perspective view of a connector of a wire harness in the first embodiment of the invention, and FIGS. 9A and 9B are diagrams of a connector housing of FIG. 8.

<Configuration of Wire Fitted Terminal 1>

In FIGS. 1 and 2, the reference numeral 1 indicates a terminal with a wire in the first embodiment of the invention. The terminal with the wire 1 is configured to include an aluminum wire 2 (wire) and a crimp terminal 3 (terminal metal fitting) which is provided at the end of the aluminum wire 2. In addition, the terminal with the wire 1 is configured to include an anticorrosion portion 4 (sealing portion and waterproofing portion) in a connection portion of heterogeneous metals of the aluminum wire 2 and the crimp terminal 3. Further, the terminal with the wire 1 of this example is provided with the crimp terminal 3 at the end of the aluminum wire 2. For example, the terminal metal fitting of an appropriate shape may be provided in the middle of the aluminum wire 2.

<Configuration and Structure of Aluminum Wire 2>

In FIGS. 1 to 4, as the aluminum wire 2, a flexible wire which has a circular shape in cross-sectional view and a reactive force is employed to returning to the original state when a bending force is applied thereto. The aluminum wire 2 is configured to include a conductor 5 and a resin covering member 6.

The conductor 5 is formed by twisting a plurality of element wires (symbol omitted) having a circular shape in cross-sectional view. The element wire is made of aluminum or aluminum alloy. In other words, the conductor 5 is made of aluminum or aluminum alloy. The conductor 5 has a predetermined conductor cross-sectional area. Then, the portion of the conductor cross-sectional area continues by the length of the aluminum wire 2. Since an aluminum material has a specific gravity of 2.70 g/cm$^3$, and a copper material described below has a specific gravity of 8.96 g/cm$^3$, the aluminum wire 2 is reduced in weight. In a case where the aluminum wire is used as an in-vehicle wire, fuel efficiency can be effectively improved.

Further, the aluminum material has a standard electrode potential of −1.676 V in an electrochemical reaction. In addition, the standard electrode potential of the copper material described below is +0.340 V. Since the potential difference is large, moisture infiltrates and remains between the aluminum material and the copper material, a battery is formed by aluminum, copper, and electrolytic aqueous solution. Then, contact corrosion (galvanic corrosion, electrolytic corrosion) between the heterogeneous metals occurs in the positive electrode of the battery (that is, the conductor 5). For this reason, the anticorrosion portion 4 is necessarily provided for preventing the electrolytic corrosion.

The resin covering member 6 is a so-called insulator, and is formed in a circular shape in cross-sectional view by extruding an insulative resin material to the outside of the conductor 5. As the resin material, various types of well-known materials may be employed. For example, a polymeric material such as polyvinylchloride resin, polyethylene resin, or polypropylene resin is appropriately selected.

The resin covering member 6 is removed from the end of the above-described aluminum wire 2 by a predetermined length to form a conductor exposed portion 7.

<Structure of Crimp Terminal 3>

In FIGS. 1 to 4, the crimp terminal 3 is a female terminal metal fitting, and is formed in a shape as illustrated in the drawings for example by pressing a copper or copper-alloy metal plate as a base material (or a male terminal metal fitting). Further, while not particularly illustrated, the surface of the base material is assumed to be plated. The plating is performed to be interposed between the copper material and the aluminum material (that is, the contact portion of the heterogeneous metals). The crimp terminal 3 includes an electrical contact portion 8, a caulking portion 9, and a connection portion 10 which connects the electrical contact portion 8 and the caulking portion 9.

The electrical contact portion 8 serves as an electrical connection portion with a mating terminal metal fitting (not illustrated), and is formed in a long cylindrical shape in cross-sectional view. In the electrical contact portion 8, an insertion space for a tab of the mating terminal metal fitting is formed. In addition, an elastic contact piece 11 is formed to make an elastic contact when the tab is inserted. The reference numeral 12 in the electrical contact portion 8 indicates an engaged portion which is used to hook and engage a lance 54 of a connector housing 52 described below.

The caulking portion 9 is an electrical connection portion with the aluminum wire 2. Since the terminal metal fitting of this example is the crimp terminal 3, the caulking portion is formed as a connectable portion when being crimped. Specifically, the caulking portion is formed by a portion including a mounting portion 13 for mounting the conductor exposed portion 7 of the aluminum wire 2, a pair of conductor caulking pieces 14 for caulking the conductor exposed portion 7 mounted in the mounting portion 13, and a pair of covering-member caulking pieces 15 for caulking the resin covering member 6 near the conductor exposed portion 7. Further, the mounting portion 13 may be called a bottom plate. In addition, the conductor caulking piece 14 may be called a wire barrel. Furthermore, the covering-member caulking piece 15 may be called an insulation barrel.

The pair of conductor caulking pieces 14 and the pair of covering-member caulking pieces 15 are disposed with a predetermined interval therebetween in an axial direction of the terminal. In addition, the pair of conductor caulking pieces 14 and the pair of covering-member caulking pieces 15 are formed in a substantial V shape before being caulked. Further, since the pair of conductor caulking pieces 14 caulks the conductor exposed portion 7, and the pair of covering-member caulking pieces 15 caulks the resin covering member 6, these caulking pieces are formed in a different width and a different extruding length according to a difference of the shapes and peripheral lengths of a caulking target.

When the conductor exposed portion 7 is crimped by the caulking portion 9, the wire-terminal connection portion is formed as indicated by the reference numeral 16. A wire-terminal connection portion 16 is formed including a conductor caulking portion 17 for caulking the conductor exposed portion 7 using the pair of conductor caulking pieces 14, a non-caulking portion 18 near the conductor caulking portion 17, and a covering-member caulking portion 19 for caulking the resin covering member 6 near the conductor exposed portion 7 using the pair of covering-member caulking pieces 15.

The connection portion 10 is formed in a substantial gutter shape extending by a predetermined length in the axial direction of the terminal. The electrical contact portion 8 is continuously formed in one end of the connection portion 10 in the axial direction of the terminal. In addition, the caulking portion 9 is continuously formed in the other end of the connection portion 10 in the axial direction of the terminal.

<Anticorrosion Portion 4>

In FIGS. 1 and 2, the anticorrosion portion 4 is formed as a portion for covering the wire-terminal connection portion 16 in a watertight manner in order to prevent the electrolytic corrosion. Specifically, defining up and down, right and left, and front and back arrows in the drawing, the anticorrosion portion 4 is formed to cover the upper side of the caulking portion 9 (the upper side of the conductor caulking portion 17 and the non-caulking portion 18), the lower side of the caulking portion 9 (the lower side of the mounting portion 13), the right and left sides of the caulking portion 9, the front side of the caulking portion 9 (the front side of the conductor caulking portion 17), the back side of the covering-member caulking portion 19. In other words, the anticorrosion portion 4 is formed to cover the front and back sides of the wire-terminal connection portion 16 and the entire periphery surround the terminal axis of the wire-terminal connection portion 16. The anticorrosion portion 4 has features in its forming method. Hereinafter, the forming method of the anticorrosion portion 4 will be described in detail while explaining the manufacturing method of the terminal with the wire 1.

<Manufacturing Method of Wire Fitted Terminal 1>

In FIGS. 5 to 7, the terminal with the wire 1 is manufactured in the following process. In other words, the wire-fitting terminal is manufactured through a wire forming process S1, a wire-terminal connection process S2, an anticorrosion material supply process S3 (sealing material supply process and waterproofing material supply process), and an anticorrosion material curing process S4 (sealing material curing process and waterproofing material curing process) in this order. The anticorrosion material supply process S3 and the anticorrosion material curing process S4 are processes (forming method) for forming the anticorrosion portion 4.

In the wire forming process S1, the conductor exposed portion 7 is formed at the end of the aluminum wire 2. Specifically, the resin covering member 6 is removed by a predetermined length to expose the conductor 5 so as to form the conductor exposed portion 7.

In the wire-terminal connection process S2, the caulking portion 9 of the crimp terminal 3 is disposed at a position of the conductor exposed portion 7, and then these portions are crimped and connected to form the wire-terminal connection portion 16. In the crimping, a crimping tool is used to press (that is, caulk) the portions by the anvil and the crimper. When the conductor exposed portion 7 is crimped to the caulking portion 9, the conductor caulking portion 17, the non-caulking portion 18, and the covering-member caulking portion 19 are formed.

In the anticorrosion material supply process S3, an anticorrosion material 20 (sealing material and waterproofing material) is supplied to the wire-terminal connection portion 16. In the anticorrosion material supply process S3, an anticorrosion material supply apparatus having the following configuration is used. The anticorrosion material supply apparatus is configured to include a dispenser (an electrostatic dispenser) which includes a metal nozzle 21, a voltage application unit 22 which applies a voltage between the metal nozzle 21 and the crimp terminal 3, and a control unit which controls the dispenser and the voltage application unit 22.

As the anticorrosion material 20, a liquid ultraviolet curable resin is employed. When a voltage is applied between the metal nozzle 21 and the crimp terminal 3, positive charges are induced in a liquid surface of the anticorrosion material 20. Further, the voltage applied between the metal nozzle 21 and the crimp terminal 3 is about 3 kV in this example. On the other hand, negative charges are induced in the crimp terminal 3.

When the voltage is applied between the metal nozzle 21 and the crimp terminal 3, the boundary of the liquid of the anticorrosion material 20 is pulled by an electrostatic force in a direction of electric flux lines. In other words, the anticorrosion material 20 is attracted in an electrified state in a direction facing the wire-terminal connection portion 16 from the metal nozzle 21. When the anticorrosion material 20 is pulled (attracted), the anticorrosion material 20 comes in contact with the wire-terminal connection portion 16 in a state of no wetting-up in the tip of the metal nozzle 21. Specifically, the anticorrosion material comes in contact with the wire-terminal connection portion in a substantial stringiness state continuing to a portion where the electric field is concentrated.

In the anticorrosion material supply process S3, the metal nozzle 21 is moved in a direction of arrows X, Y, and Z illustrated in FIGS. 5 and 6 when the anticorrosion material 20 is supplied. The anticorrosion material 20 is supplied in an electrified state. Therefore, the anticorrosion material 20 is attracted to the wire-terminal connection portion 16 by the electrostatic force. Thereafter, the anticorrosion material is supplied in a state of going around to the opposite side of the supply position. In other words, even being supplied from the upper side, the anticorrosion material 20 is supplied all over the peripheral surface including the lower side of the wire-terminal connection portion 16. The anticorrosion material 20 supplied to the entire peripheral surface of the wire-terminal connection portion 16 is not dropped but remains at that place by an attracting force caused by the electrostatic force. Besides, the anticorrosion material 20 infiltrates and remains in the element wire of the conductor 5 in the non-caulking portion 18.

In the anticorrosion material curing process S4, the anticorrosion material 20 supplied to the entire peripheral surface of the wire-terminal connection portion 16 is irradiated with the ultraviolet ray (UV light) so as to be UV-cured. The anticorrosion material 20 is made of a liquid ultraviolet curable resin. Therefore, for example, when receiving energy caused by the ultraviolet ray of the UV lamp 23, the anticorrosion material is cured in a short time while keeping the remaining state. When the anticorrosion material 20 is cured, the anticorrosion portion 4 covering the wire-terminal connection portion 16 in a watertight manner is formed completely. In other words, the terminal with the wire 1 is completely manufactured.

The anticorrosion portion 4 can be formed in a sufficient state as described above. In addition, the anticorrosion portion 4 may be formed in a shape having a maximum width of W1 and a maximum height of H1. This is because the supply amount of the anticorrosion material 20 can be managed with accuracy since the anticorrosion material is supplied in a stringiness state as described above and, as a result, the shape of the anticorrosion portion 4 becomes stable. When the shape of the anticorrosion portion 4 is made stable, a connector 51 described below will be effectively assembled.

<Applications of Wire Fitted Terminal 1>

In FIG. 8, the terminal with the wire 1 is used as a component of the connector 51 which is disposed at the end of the wire harness. The connector 51 is configured to include the insulative connector housing 52 besides the pair of wire fitted terminals 1.

In FIGS. 8 and 9, the connector housing 52 is a resin molded article formed in a rectangular box shape. A pair of terminal housing chambers 53 is formed in the connector housing 52. The terminal housing chamber 53 is formed to pass through the connector housing 52 from the front surface to the back surface. The lance 54 is formed in the terminal housing chamber 53 to hook and engage the crimp terminal 3 (engaged portion 12) of the terminal with the wire 1. In addition, a stopper portion 55 abutting on the crimp terminal 3 and a tab insertion hole 56 to which the tab of a mating terminal metal fitting (not illustrated) is inserted are formed in the terminal housing chamber 53.

The terminal housing chamber 53 is formed to include openings having a width of W2 and a height of H2 in the back surface of the connector housing 52. The width W2 is larger than a maximum width W1 of the anticorrosion portion 4 (W2>W1). In addition, the height H2 is also larger than a maximum height H1 of the anticorrosion portion 4 (H2>H1). In other words, even when the terminal with the wire 1 includes the anticorrosion portion 4, there is no problem in containing the crimp terminal 3 in the terminal housing chamber 53.

On the outside of the connector housing 52, a guide rib 57 provided for a mating connector (not illustrated) and a locking arm 58 are formed.

<Summary and Effect of Wire Fitted Terminal 1 in First Embodiment>

Hitherto, as described with reference to FIGS. 1 to 9, the terminal with the wire 1 is configured to include the aluminum wire 2 and the crimp terminal 3. The aluminum wire 2 is configured to include the conductor 5 made of aluminum or aluminum alloy, and the insulative resin covering member 6 which covers the conductor 5. The resin covering member 6 is removed from the aluminum wire 2 to form the conductor exposed portion 7 (the wire forming process S1). On the other hand, the crimp terminal 3 includes the caulking portion 9 as a crimp portion. In the caulking portion 9, the pair of conductor caulking pieces 14 and the covering-member caulking piece 15 are formed. In the terminal with the wire 1, the wire-terminal connection portion 16 is formed by crimping the caulking portion 9 to the conductor exposed portion 7 (the wire-terminal connection process S2). Then, the anticorrosion portion 4 is formed to cover the wire-terminal connection portion 16. The anticorrosion portion 4 is formed by applying a voltage between the crimp terminal 3 and the metal nozzle 21 and by supplying the electrified anticorrosion material 20 from the metal nozzle 21 to the wire-terminal connection portion 16 in the attracted state (the anticorrosion material supply process S3). In addition, the anticorrosion portion 4 is formed by irradiating the anticorrosion material 20 supplied to the wire-terminal connection portion 16 with the ultraviolet ray so as to be UV-cured (the anticorrosion material curing process S4).

According to the terminal with the wire 1, the anticorrosion material 20 is attracted to the wire-terminal connection portion 16 by the electrostatic force when the anticorrosion portion 4 is formed. In addition, since the attracting force caused by the electrostatic force is applied on the anticorrosion material 20 supplied to the wire-terminal connection portion 16, the anticorrosion material 20 remains in the wire-terminal connection portion 16.

In addition, according to the terminal with the wire 1, the electrified anticorrosion material 20 is attracted by the electrostatic force and goes around to the opposite side of the supply position when the anticorrosion portion 4 is formed. In other words, the anticorrosion material 20 is supplied over the entire peripheral surface of the wire-terminal connection portion 16. The anticorrosion material 20 supplied over the entire peripheral surface is not dropped but remains at that place by the attracting force caused by the electrostatic force.

In addition, according to the terminal with the wire 1, the anticorrosion material 20 made of the ultraviolet curable resin is employed when the anticorrosion portion 4 is formed. Since the anticorrosion material 20 is applied with the attracting force caused by the electrostatic force, the anticorrosion material 20 remains in the wire-terminal connection portion 16. In the remaining state, for example, when being irradiated with the ultraviolet ray by the UV lamp 23, the anticorrosion material 20 receives the energy caused by the ultraviolet ray and then cured while keeping the remaining state.

In addition, according to the terminal with the wire 1, when the anticorrosion portion 4 is formed, the wire-terminal connection portion 16 is formed including the conductor caulking portion 17, the non-caulking portion 18 near the conductor caulking portion, and the covering-member caulking portion 19. In other words, the anticorrosion portion 4 is formed in a relative wide range.

Therefore, according to the terminal with the wire 1 in the first embodiment of the invention, it is possible to effectively provide the terminal with the wire 1 having a high anticorrosion property and the manufacturing method thereof.

<Second Embodiment>

Figure 13A:
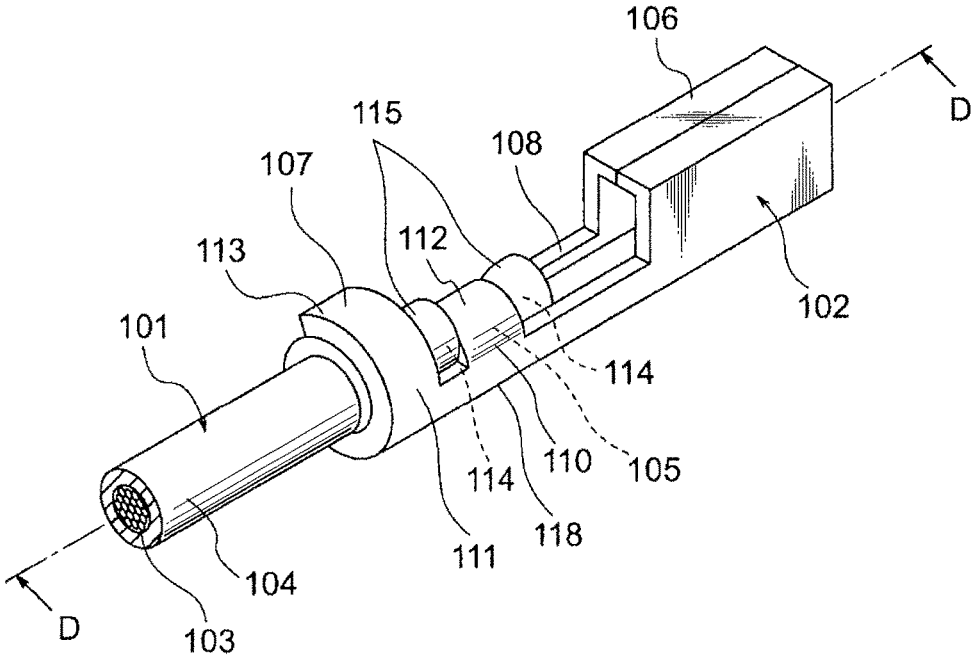
FIG. 13A PRIOR ART
Figure 13B:
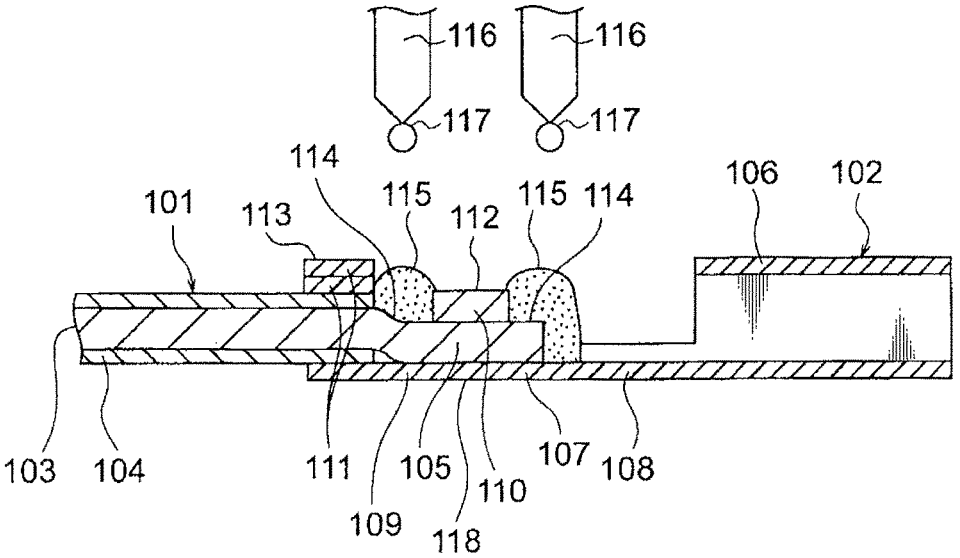
FIG. 13B PRIOR ART

In the conventional technique described above with reference to FIGS. 13A and 13B, the anticorrosion material 117 is dropped from the respective nozzles 116 of two dispensers. Then, the anticorrosion material 117 thus dropped and coated is cured to form the anticorrosion portion 115. In the forming method of the conventional example, it takes a time for curing the anticorrosion material 117, and when the liquid dropping or the sink mark occurs, there is a problem in manufacturability. In addition, in a case where a coating range of the anticorrosion material 117 is not defined clearly, the anticorrosion portion 115 may be insufficiently formed.

Furthermore, in the above conventional technique, in a case where bubbles are generated in the coated anticorrosion material 117 and burst out at the time of curing the anticorrosion material 117, the anticorrosion portion 115 may be degraded in its function.

The second embodiment is made in view of such problems, and provides A terminal with a wire which is excellent in manufacturability and has a high sealing property (high anticorrosion property and high waterproofing property), a manufacturing method of the terminal with the wire, and a wire harness.

The terminal with the wire is configured to include an aluminum wire and a crimp terminal. The aluminum wire is configured to include an aluminum or aluminum alloy conductor and an insulative resin covering member which covers the conductor. The resin covering member is removed from the aluminum wire to form a conductor exposed portion (the wire forming process). The crimp terminal includes a caulking portion as a crimp portion. In the caulking portion, a conductor caulking piece and a covering-member caulking piece are formed. In the terminal with the wire, the caulking portion is crimped to the conductor exposed portion to form a wire-terminal connection portion (the wire-terminal connection process). Then, an anticorrosion portion is formed to cover the wire-terminal connection portion. The anticorrosion portion is formed such that the anticorrosion material which is made of the ultraviolet curable resin and emits the light when receiving the energy of the ultraviolet ray is supplied to the wire-terminal connection portion (the anticorrosion material supply process), and the anticorrosion material is irradiated with the ultraviolet ray so as to be UV-cured (the anticorrosion material curing process).

[Examples]

Hereinafter, examples of the second embodiment will be described with reference to the drawings. Further, the following examples of the second embodiment are different from those of the first embodiment in the anticorrosion material of the anticorrosion portion and the anticorrosion material curing process in the manufacturing method. On the other hand, the terminal with the wire, the manufacturing method, and the basic configuration of the wire harness are equal to those of the examples of the first embodiment. In the following, the examples of the second embodiment will be described focusing on the differences from those of the first embodiment.

Figure 10:
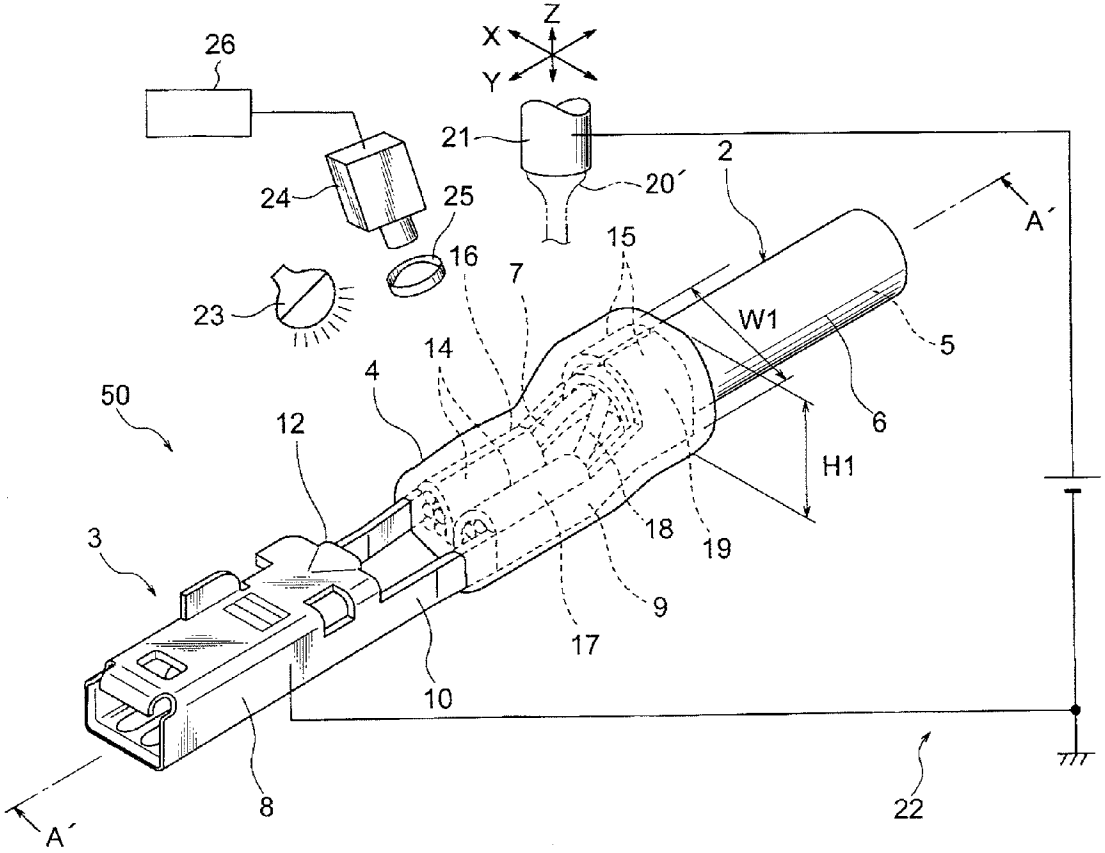
FIG. 10 is a perspective view of a terminal with a wire for describing a manufacturing method in a second embodiment of the invention.
Figure 11:
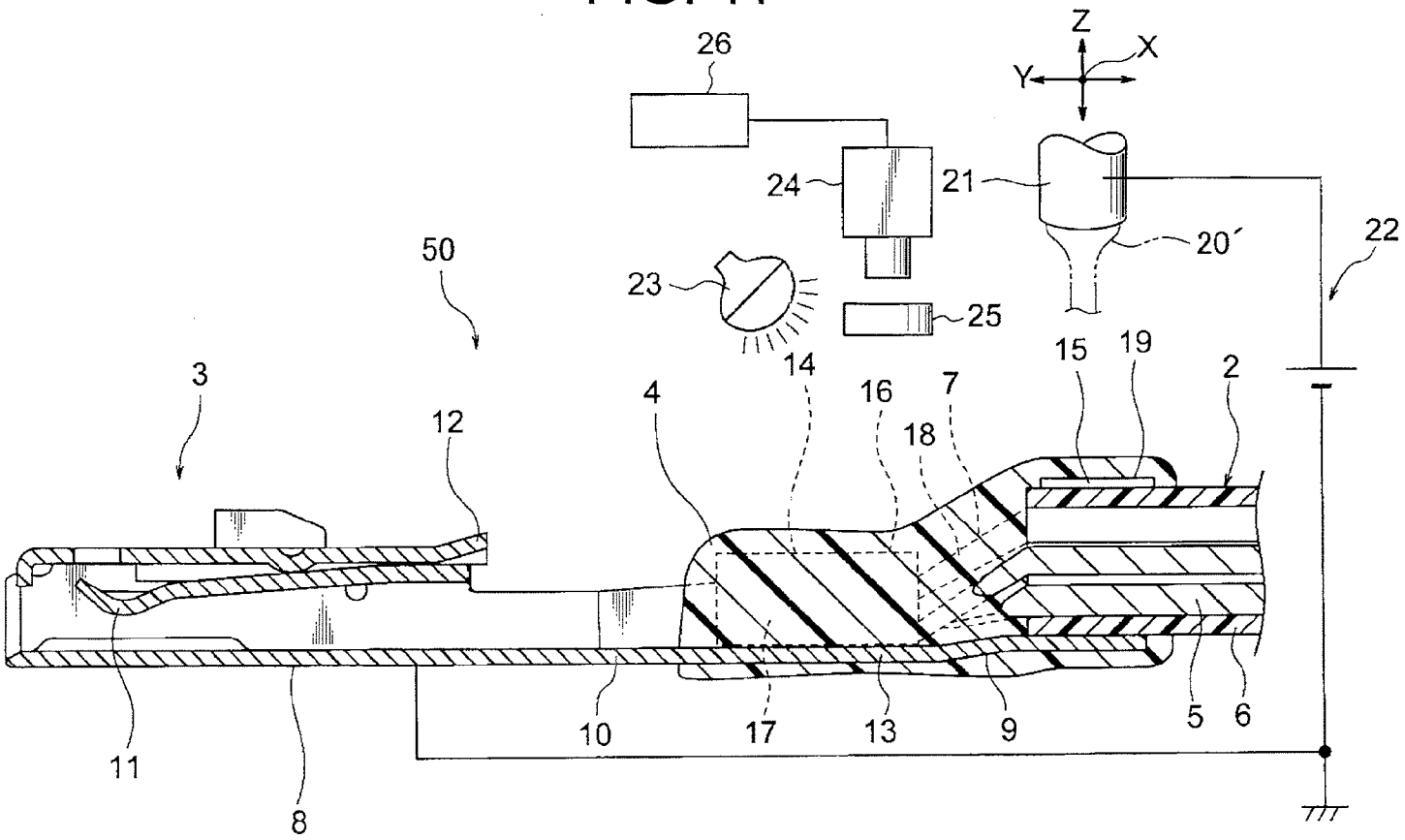
FIG. 11 is a cross-sectional view taken along a line A'-A' of FIG. 10.
Figure 12:
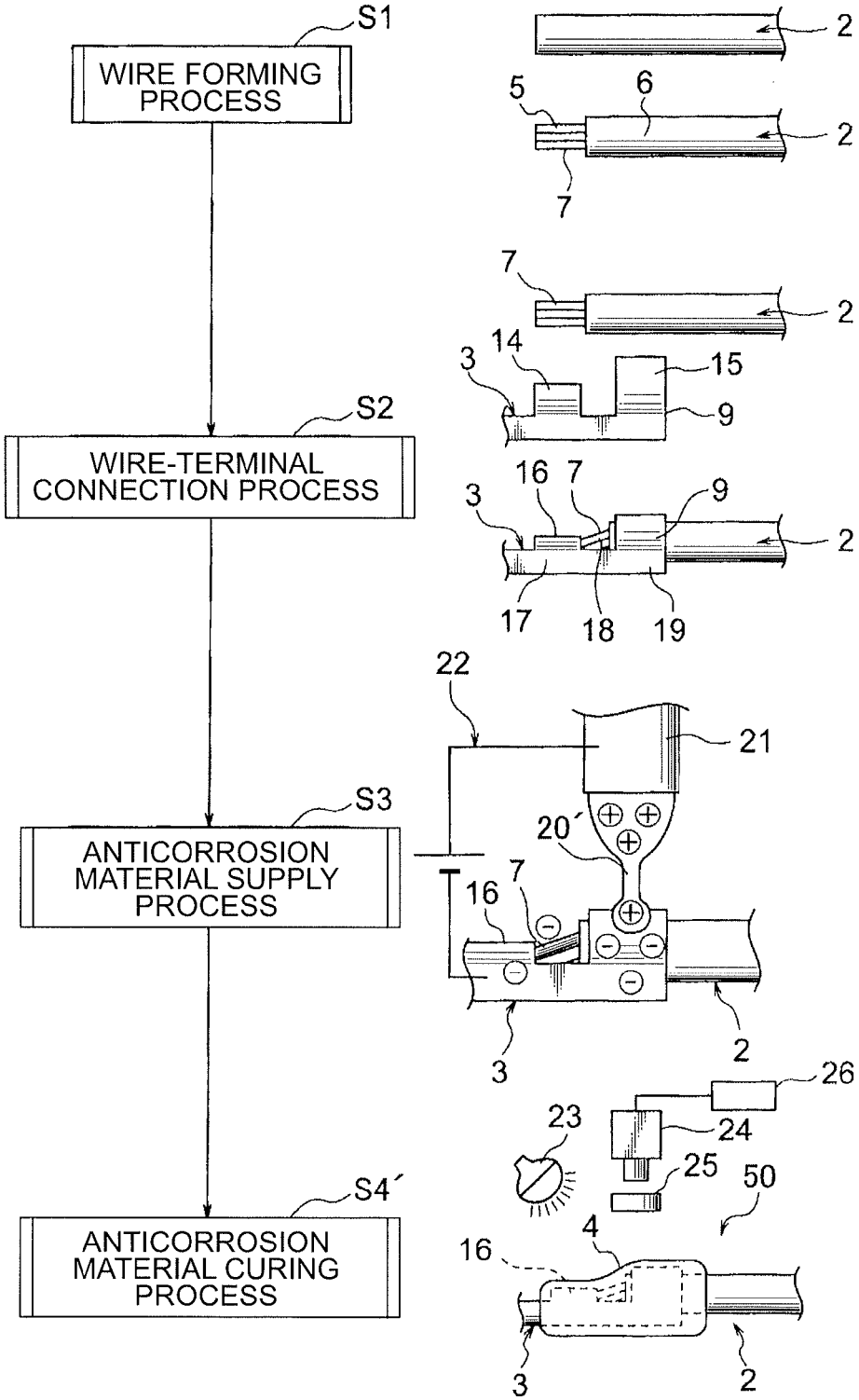
FIG. 12 is a diagram for describing a process of the manufacturing method in the second embodiment of the invention.

FIG. 10 is a perspective view of the terminal with the wire for describing the manufacturing method in the second embodiment of the invention, FIG. 11 is a cross-sectional view taken along a line A'-A' of FIG. 10, and FIG. 12 is a diagram for describing a process of the manufacturing method in the second embodiment of the invention. Further, in FIGS. 10 to 12, the same components as those illustrated in FIGS. 5 to 7 described in the examples of the first embodiment will be denoted by the same symbols as those of FIGS. 5 to 7. In the following, the redundant description on the same components will be omitted.

In the examples of the second embodiment, a liquid ultraviolet curable resin is employed as an anticorrosion material 20'. In addition, as the anticorrosion material 20', a material emitting the light when receiving the energy of the ultraviolet ray is employed.

Then, in an anticorrosion material curing process S4', the anticorrosion material 20' supplied over the entire peripheral surface of the wire-terminal connection portion 16 is irradiated with the ultraviolet ray (UV light) so as to be UV-cured. The anticorrosion material 20' is made of a liquid ultraviolet curable resin. Therefore, for example, when receiving energy caused by the ultraviolet ray of a UV lamp 23, the anticorrosion material is cured in a short time while keeping the remaining state. At this time, the anticorrosion material 20' is cured without causing the liquid dropping and the sink mark. When the anticorrosion material 20' is cured, the anticorrosion portion 4 covering the wire-terminal connection portion 16 in a watertight manner is formed completely. In other words, the terminal with the wire 50 is completely manufactured.

In the anticorrosion material curing process S4', since the anticorrosion material 20' emits the light when receiving the energy of the ultraviolet ray, it is determined whether a supply area of the anticorrosion material 20' supplied to the wire-terminal connection portion 16 is suitable using the anticorrosion material 20' in the light emitting state. In other words, a quality determination on the supply area is performed. In the quality determination on the supply area, a quality determination apparatus is used. The quality determination apparatus is configured to include a camera 24, an optical filter 25, a camera control unit (not illustrated), and a quality determination unit 26.

When the anticorrosion material 20' receives the energy of the ultraviolet ray and emits the light, the quality determination apparatus captures the anticorrosion material 20' in the light emitting state using the camera 24, determines whether the supply area of the anticorrosion material 20' is suitable using the quality determination unit 26 based on the captured image, and outputs the determination result to a display for example. Further, in the quality determination apparatus, the optical filter 25 is disposed to be interposed between the anticorrosion material 20' and the camera 24. The reason is to clearly capture the image of the anticorrosion material 20' in the light emitting state while eliminating a disturbance light generated at the time of emitting the ultraviolet ray.

After capturing the image of the anticorrosion material 20' in the light emitting state, the quality determination apparatus simultaneously determines whether there is a bubble in the anticorrosion material 20' from the image. The determination is performed by the quality determination unit 26. In addition, the quality determination apparatus simultaneously outputs the determination result to the display. When it is determined that there is no bubble in the anticorrosion material 20', it is a matter of course that there is no way for the bubble to burst out at the time of curing the anticorrosion material 20'.

The anticorrosion portion 4 can be formed in a sufficient state as described above. In addition, the anticorrosion portion 4 may be formed in a shape having a maximum width of W1 and a maximum height of H1. This is because the supply amount of the anticorrosion material 20' can be managed with accuracy since the anticorrosion material is supplied in a stringiness state as described above and, as a result, the shape of the anticorrosion portion 4 becomes stable. In addition, this is because the anticorrosion material 20' is formed after the quality of the supply area thereof is determined. When the shape of the anticorrosion portion 4 is made stable, the connector 51 described with reference to FIGS. 8 and 9 is effectively assembled.

<Summary and Effect of Wire Fitted Terminal 50 in Second Embodiment>

Hitherto, as described with reference to FIGS. 10 to 12, the terminal with the wire 50 is configured to include the aluminum wire 2 and the crimp terminal 3. The aluminum wire 2 is configured to include the conductor 5 made of aluminum or aluminum alloy, and the insulative resin covering member 6 which covers the conductor 5. The resin covering member 6 is removed from the aluminum wire 2 to form the conductor exposed portion 7 (the wire forming process S1). On the other hand, the crimp terminal 3 includes the caulking portion 9 as a crimp portion. In the caulking portion 9, the pair of conductor caulking pieces 14 and the covering-member caulking piece 15 are formed. In the terminal with the wire 50, the caulking portion 9 is crimped to the conductor exposed portion 7 to form the wire-terminal connection portion 16 (the wire-terminal connection process S2). Then, the anticorrosion portion 4 is formed to cover the wire-terminal connection portion 16.

The anticorrosion portion 4 is formed by supplying the wire-terminal connection portion 16 with the anticorrosion material 20' which is made of the ultraviolet curable resin and emits the light when receiving the energy of the ultraviolet ray (the anticorrosion material supply process S3). In addition, the anticorrosion portion 4 is formed by irradiating the anticorrosion material 20' with the ultraviolet ray using the UV lamp 23 so as to be UV-cured (the anticorrosion material curing process S4'). When the ultraviolet ray is emitted by the UV lamp 23, the capturing is performed by the camera 24 while eliminating the disturbance light using the optical filter 25. Then, the quality of the supply area of the anticorrosion material 20' is determined based on the image captured by the camera 24, and the presence/absence of the bubble in the anticorrosion material 20' is also determined.

According to the terminal with the wire 50 and the manufacturing method thereof, the anticorrosion material 20' made of the ultraviolet curable resin as described above is employed and irradiated with the ultraviolet ray, so that the anticorrosion material 20' can be cured in a short time. In other words, the anticorrosion portion 4 can be formed in a short time without causing the liquid dropping and the sink mark.

In addition, according to the terminal with the wire 50 and the manufacturing method thereof, the anticorrosion material 20' which emits the light when receiving the energy of the ultraviolet ray is employed, so that the quality determination on the supply area of the anticorrosion material 20' can be made easily. In addition, according to the terminal with the wire 50 and the manufacturing method thereof, the emission state of the anticorrosion material 20' is captured as an image, so that, the quality determination on the supply area of the anticorrosion material 20' can be made reliably. In addition, according to the terminal with the wire 50 and the manufacturing method thereof, the optical filter 25 is disposed to be interposed between the anticorrosion material 20' and the camera 24, so that the emission state of the anticorrosion material 20' can be captured as an image while eliminating the disturbance light. As a result, the quality determination on the supply area of the anticorrosion material 20' can be made more reliably using such an image. In other words, when the supply of the anticorrosion material 20' is suitable, the anticorrosion portion 4 can be formed in a sufficient state.

In addition, according to the terminal with the wire 50 and the manufacturing method thereof, when the anticorrosion material 20' is irradiated with the ultraviolet ray to emit the light so as to be captured as an image, it is possible to determine whether there is a bubble in the anticorrosion material 20'. Then, when it is determined that there is no bubble in the anticorrosion material 20', the formation state of the anticorrosion portion 4 can be considered as sufficient.

Therefore, according to the invention, it is possible to provide the terminal with the wire 50 which is excellent in manufacturability and has a high anticorrosion property, and the manufacturing method thereof.

It is a matter of course that various changes can be made within a scope not departing from the spirit of the invention.

REFERENCE SIGNS LIST

1, 50 terminal with wire
2 aluminum wire (wire)
3 crimp terminal (terminal metal fitting)
4 anticorrosion portion (sealing portion and waterproofing portion)
5 conductor
6 resin covering member
7 conductor exposed portion
8 electrical contact portion
9 caulking portion
10 connection portion
11 elastic contact piece
12 engaged portion
13 mounting portion
14 conductor caulking piece
15 covering-member caulking piece
16 wire-terminal connection portion
17 conductor caulking portion
18 non-caulking portion
19 covering-member caulking portion
20, 20' anticorrosion material (sealing material, waterproofing material)
21 metal nozzle
22 voltage application unit
23 UV lamp
24 camera
25 optical filter
26 quality determination unit
51 connector
52 connector housing
53 terminal housing chamber
54 lance
55 stopper portion
56 tab insertion hole
57 guide rib
58 locking arm
S1 wire forming process
S2 wire-terminal connection process
S3 anticorrosion material supply process (sealing material supply process, waterproofing material supply process)
S4, S4' anticorrosion material curing process (sealing material curing process, waterproofing material curing process)

What is claimed is:

1. A manufacturing method of a terminal with a wire, comprising:

a wire forming process in which a resin covering member is removed from the wire to form a conductor exposed portion;

a wire-terminal connection process in which a terminal metal fitting is connected at a position of the conductor exposed portion to form a wire-terminal connection portion; and a sealing material supply process in which a voltage is applied between the terminal metal fitting and a metal nozzle, and an electrified sealing material is supplied from the metal nozzle to the wire-terminal connection portion in a state of being attracted to form a sealing portion for covering the wire-terminal connection portion.

2. The manufacturing method of the terminal with the wire according to claim 1, wherein, in the sealing material supply process, the electrified sealing material is supplied to the wire-terminal connection portion in one predetermined direction, and the electrified sealing material is spread over the entire peripheral surface around an axis of the terminal metal fitting in the wire-terminal connection portion by an electrostatic force.

3. The manufacturing method of the terminal with the wire according to claim 1, wherein the electrified sealing material is supplied in a substantial stringiness state continuing from the metal nozzle to the wire-terminal connection portion.

4. The manufacturing method of the terminal with the wire according to claim 1, further comprising a sealing material curing process UV-curing the electrified sealing material so as to form the sealing portion as a process after the sealing material supply process.

5. The manufacturing method of the terminal with the wire according to claim 1, wherein, as the wire-terminal connection process, the wire-terminal connection portion is formed in a range containing a conductor caulking portion which caulks the conductor exposed portion using a conductor caulking piece of the terminal metal fitting, a non-caulking portion near the conductor caulking portion, and a covering-member caulking portion which caulks the resin covering member near the conductor exposed portion using a covering-member caulking piece of the terminal metal fitting.

* * * * *